US006767406B2

(12) United States Patent
Vitale

(10) Patent No.: US 6,767,406 B2
(45) Date of Patent: Jul. 27, 2004

(54) CONVEYOR PAINTING SYSTEM

(75) Inventor: Donald Vitale, Camp Hill, PA (US)

(73) Assignee: Ames True Temper, Inc., Camp Hill, PA (US)

( * ) Notice: Subject to any disclaimer, the term of this patent is extended or adjusted under 35 U.S.C. 154(b) by 0 days.

(21) Appl. No.: 10/338,900

(22) Filed: Jan. 9, 2003

(65) Prior Publication Data

US 2003/0205198 A1 Nov. 6, 2003

Related U.S. Application Data

(60) Provisional application No. 60/376,540, filed on May 1, 2002.

(51) Int. Cl.[7] ..... B05C 3/10

(52) U.S. Cl. ..... 118/421; 118/423; 118/630; 118/641; 118/66; 118/72; 118/73; 118/324; 134/63

(58) Field of Search ..... 118/421, 423, 118/400, 620, 58, 66, 72, 73, 621, 630, 641, 324; 427/421, 430.1; 134/61, 63, 77

(56) References Cited

U.S. PATENT DOCUMENTS

| | | | | | |
|---|---|---|---|---|---|
| 1,455,585 | A | | 5/1923 | Griffith | 118/425 |
| 2,675,778 | A | | 4/1954 | Peeps | 118/685 |
| 2,755,205 | A | | 7/1956 | Robb et al. | 427/235 |
| 3,076,429 | A | | 2/1963 | Sprague | 118/322 |
| 3,150,996 | A | | 9/1964 | Johnson | 118/102 |
| 3,253,943 | A | | 5/1966 | Mayer et al. | 427/235 |
| 3,356,061 | A | | 12/1967 | Wiggins | 118/682 |
| 3,487,812 | A | | 1/1970 | Salzwedel | 118/232 |
| 3,513,808 | A | | 5/1970 | Mortimer et al. | 118/702 |
| 3,573,186 | A | | 3/1971 | Ryerson et al. | 204/203 |
| 3,643,626 | A | | 2/1972 | McKay et al. | 118/58 |
| 3,952,698 | A | * | 4/1976 | Beyer et al. | 118/314 |
| 4,036,168 | A | * | 7/1977 | Laliberte et al. | 118/675 |
| 4,887,762 | A | | 12/1989 | Baker | 228/260 |
| 4,957,059 | A | | 9/1990 | Daughenbaugh | 118/423 |
| 5,275,849 | A | * | 1/1994 | Castelli et al. | 427/461 |
| 5,503,673 | A | * | 4/1996 | Berta | 118/16 |
| 5,989,644 | A | | 11/1999 | Williams | 427/424 |

* cited by examiner

*Primary Examiner*—Laura Edwards
(74) *Attorney, Agent, or Firm*—Brij K. Agarwal; Eckert Seamans Cherin & Mellott, LLC

(57) ABSTRACT

A painting apparatus includes a conveyor having incrementally spaced attachment structures configured to secure objects thereon for painting and being movable to move the attachment structures between consecutive incremental positions in a downstream direction. The distance between consecutive incremental positions is generally equal to an incremental spacing between consecutive attachment structures. A washing station is disposed beneath the conveyor and is operable to clean objects disposed therein. A painting station downstream of the washing station includes a paint reservoir disposed beneath the conveyor and which contains a volume of paint. The reservoir can be raised to dispose the object within the volume of paint and lowered to thereby allow the object to be conveyed downstream from the painting incremental position. A heating station downstream of the paint reservoir applies heat to objects in a heating incremental position.

86 Claims, 19 Drawing Sheets

CONVEYOR PAINTING SYSTEM

This application claims priority to U.S. Provisional Patent Application serial No. 60/376,540, which application is hereby incorporated herein by reference in its entirety for all material disclosed therein.

FIELD OF THE INVENTION

The present invention relates to painting systems. More particularly, illustrative embodiments of the invention relate to conveyor painting systems.

BACKGROUND OF THE INVENTION

Conveyor painting systems are known and have been used to carry a succession of uncoated (e.g., unpainted) objects through a stationary volume of coating material (e.g., paint) to coat each object with the coating material. Examples are found in U.S. Pat. No. 2,755,205 to Robb et al., U.S. Pat. No. 3,253,943 to Mayer et al. and U.S. Pat. No. 3,150,996 to Johnson. Prior conveyor painting systems have numerous disadvantages, however, including limited functionality, limited mobility and mechanical complexity.

SUMMARY OF THE INVENTION

One aspect of the invention provides a washing and painting apparatus for washing and painting objects that are moved by a conveyor. The apparatus includes an apparatus frame structure and an endless conveyor assembly mounted to the frame structure. The conveyor assembly includes a conveyor having a series of incrementally spaced attachment structures thereon configured to secure objects thereon for washing and painting. The conveyor is movable for moving the attachment structures between consecutive incremental positions along the frame structure in a downstream conveying direction. The distance between consecutive incremental positions is generally equal to an incremental spacing between consecutive attachment structures. The washing and painting apparatus further comprises a washing station and a washing station lift mechanism. The washing station includes a washing receptacle structure that is disposed beneath the conveyor and that is configured to apply a cleaning solution to objects disposed therein. The washing station lift mechanism is constructed to move the washing receptacle structure between (a) a raised position wherein the washing receptacle structure is raised upwardly to receive therein one of the objects which is in a washing incremental position so as to apply the cleaning solution to surfaces of the object and (b) a lowered position wherein the washing receptacle structure is disposed below a vertical extent of the object to thereby allow the object to be conveyed downstream from the washing incremental position. The washing and painting apparatus further includes a painting station and a painting station lift mechanism. The painting station includes an upwardly open paint reservoir disposed beneath the conveyor downstream of the washing receptacle structure. The paint reservoir is configured to contain a volume of paint therein. The painting station lift mechanism is constructed to move the paint reservoir between (a) a raised position wherein the paint reservoir is raised upwardly to receive therein one of the objects which is in a painting incremental position so as to dispose the object within the volume of paint and (b) a lowered position wherein the paint reservoir is disposed below the vertical extent of the object to thereby allow the object to be conveyed downstream from the painting incremental position. The washing and painting apparatus also includes a heating station that includes one or more heaters disposed along the conveyor downstream of the paint reservoir and that is constructed to apply heat to one of the objects which is in a heating incremental position.

Another aspect of the invention provides a painting apparatus for painting objects that are moved by a conveyor, but not necessarily having a washing station. The apparatus includes an apparatus frame structure and an endless conveyor assembly mounted to the frame structure. The endless conveyor assembly includes an upright looped conveyor having a series of incrementally spaced attachment structures thereon configured to secure objects thereon for painting. The conveyor is movable for moving the attachment structures between consecutive incremental positions along the frame structure in a downstream conveying direction. The distance between consecutive incremental positions is generally equal to an incremental spacing between consecutive attachment structures. The painting apparatus also includes a painting station and a painting station lift mechanism. The painting station includes an upwardly open paint reservoir that is disposed beneath the conveyor and that is configured to contain a volume of paint therein. The painting station lift mechanism is constructed to move the paint reservoir between (a) a raised position wherein the paint reservoir is raised upwardly to receive therein one of the objects which is in a painting incremental position so as to dispose the object within the volume of paint and (b) a lowered position wherein the paint reservoir is disposed below the vertical extent of the object to thereby allow the object to be conveyed downstream from the painting incremental position. The painting apparatus further includes a heating station. The heating station includes one or more heaters disposed along the conveyor downstream of the paint reservoir and is constructed to apply heat to one of the objects which is in a heating incremental position.

Another aspect of the invention provides a washing and painting apparatus for washing and painting objects that includes a conveyor for moving the objects to be painted, but which may include any type of painting station and not necessarily one that is lifted. The apparatus includes an apparatus frame structure and an endless conveyor assembly mounted to the frame structure. The endless conveyor assembly includes a conveyor having a series of incrementally spaced attachment structures thereon configured to secure objects thereon for washing and painting. The conveyor is movable for moving the attachment structures between consecutive incremental positions along the frame structure in a downstream conveying direction. The distance between consecutive incremental positions is generally equal to an incremental spacing between consecutive attachment structures. The washing and painting apparatus further includes a washing station and a washing station lift mechanism. The washing station includes a washing receptacle structure disposed beneath the conveyor and configured to apply a cleaning solution to objects disposed therein. The washing station lift mechanism is constructed to move the washing receptacle structure between (a) a raised position wherein the washing receptacle structure is raised upwardly to receive therein one of the objects which is in a washing incremental position so as to apply the cleaning solution to surfaces of the object and (b) a lowered position wherein the washing receptacle structure is disposed below a vertical extent of the object to thereby allow the object to be conveyed downstream from the washing incremental position. The washing and painting apparatus also includes a painting station and a painting station lift mechanism. The painting station is disposed beneath the conveyor downstream of the washing receptacle structure and includes a paint reservoir, the paint reservoir being configured to apply paint to one of the objects which is in a painting incremental position. The washing and painting apparatus also includes a heating station. The heating station includes one or more heaters disposed along the conveyor downstream of the paint reservoir and is' constructed to apply heat to one of the objects which is in a heating incremental position.

Another aspect of the invention provides a painting apparatus for painting objects that includes an improved painting station for handling excess paint. The apparatus includes an apparatus frame structure and an endless conveyor assembly mounted to the frame structure. The conveyor assembly includes an upright looped conveyor having a series of incrementally spaced attachment structures thereon configured to secure objects thereon for washing and painting. The conveyor is movable for moving the attachment structures between consecutive incremental positions along the frame structure in a downstream conveying direction. The distance between consecutive incremental positions is generally equal to an incremental spacing between consecutive attachment structures. The washing and painting apparatus further includes a painting station. The painting station includes an upwardly open paint reservoir that is disposed beneath the conveyor and that is configured to contain a volume of paint therein. The washing and painting apparatus also includes a mechanism constructed to effect relative vertical movement between one of the objects which is in a painting incremental position and the paint reservoir structure so as to dispose the object within the volume of paint. The painting station also includes a paint recollection receptacle that is disposed adjacent the paint reservoir structure and extends downstream therefrom to a subsequent incremental position and that is configured to catch excess paint which drips from objects in the subsequent incremental position. The interiors of the paint reservoir and the paint recollection receptacle are separated from one another via at least a wall member. The painting station includes a pump mechanism communicated with the interiors of the paint reservoir and the paint recollection receptacle and is constructed to transport the excess paint caught by the recollection receptacle into the paint reservoir.

Other embodiments of the invention and other aspects, features, and advantages of the present invention will become apparent from the following detailed description of the illustrated embodiments, the accompanying drawings, and the appended claims.

DETAILED DESCRIPTION

Figure 1:
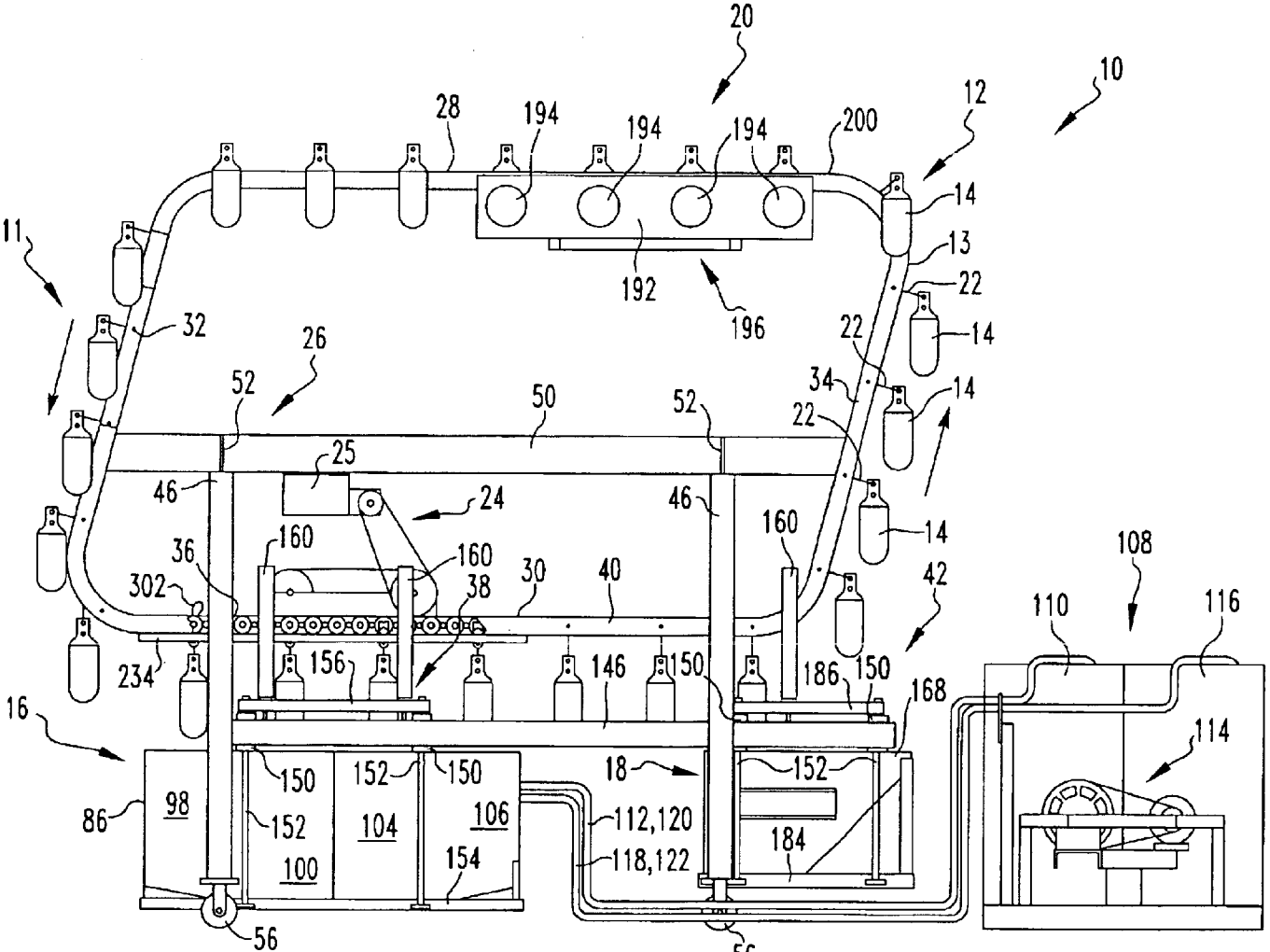
FIGS. 1 and 2 are side views of an illustrative embodiment of a painting apparatus embodying principles of the present invention.

FIG. 1 shows a painting apparatus 10 embodying principles of the present invention. The painting apparatus 10 includes an upright, endless conveyor assembly 12 that includes a conveyor mechanism 13 that may be in the form of a closed loop, although this is not required. The closed loop conveyor assembly 12 may be operated to receive a series of unpainted objects 14 at a first general location II on the conveyor assembly 12 and to convey the objects 14 around the loop (in a generally counterclockwise in FIG. 1, for example) back to the first location. As the objects 14 move around the looped conveyor assembly 12, they are processed at one or more stations disposed along the conveyor assembly 12. The stations include at least a painting station where the objects are painted. The painted objects 14 may be removed from the conveyor assembly 12 when they move back to the first location. Objects 14 moving around the conveyor mechanism 13 in the counterclockwise direction are described as moving in a "downstream" direction.

A painting apparatus constructed according to the present invention may include several stations that are disposed along the length of the conveying mechanism 13. The illustrative painting apparatus 10, for example, includes a washing station 16, a painting station 18, and a heating or drying station 20 consecutively spaced along the conveyor mechanism 13 in the downstream or conveying direction. Unpainted objects that are attached to the conveying mechanism 13 in the area 11 of the painting apparatus 10 move first to the washing station 16, move next to the painting station 18, then to the heating station 20 and back to the area 11 where the painted objects are removed.

The conveying mechanism 13 and the various stations 16, 18, 20 may be controlled and operated manually (that is, by a human operator), may be controlled and operated electronically (using, for example, an electronic control system which may include, for example, a programmable microprocessor), or may be controlled using a combination of manual and electronic control. The conveying mechanism 13 may be stopped periodically during the processing of the objects so that the objects 14 are in a generally fixed loop position while each processing operation is being carried out. The objects 14 may be incrementally spaced along the length of the conveying mechanism 13 and the various stations 16, 18, 20 may have a corresponding incremental spacing around the conveying mechanism 13 so that when an object is disposed in the one of the stations (station 16, for example) in a position to be processed at that station, other objects are disposed in each downstream station (stations 18, 20 in the illustrative embodiment of FIG. 1, for example) in a position to be processed at the downstream stations.

The conveyor mechanism 13 includes an series of attachment structures 22 that are spaced incrementally along the length of the conveying mechanism 13. One or more objects 14 may be attached to each attachment structure 22. The attachment structures 22 and the objects 14 attached thereto are driven or conveyed about the conveyor mechanism 13 by a drive assembly 24 that includes an electric motor 25 drivingly coupled to the conveyor mechanism 13. The construction of the conveyor mechanism 13 is discussed in detail below.

An apparatus frame structure 26 supports the conveyor mechanism 13 in its upright configuration. The conveyor mechanism 13 includes horizontal upper and lower segments 28, 30, which are generally paralell to one another (although this is not required), and first and second generally inclined side segments 32, 34 interconnecting the upper and lower segments 28, 30. The first and second side segments 32, 34 may be parallel to one another. The conveying mechanism 13 is generally in the shape of a parallelogram, but this shape of the conveyor mechanism 13 is illustrative only and is not intended to be limiting. Generally, the conveyor mechanism 13 may be constructed to have any appropriate shape.

A painting apparatus may optionally include a washing station that is operable to clean and/or prepare each object for painting. In the illustrative embodiment of FIG. 1, for example, a washing station 16 is positioned relative to the conveyor mechanism 13 beneath and adjacent to an upstream portion 36 of the lower segment 30. The washing station 16 may be connected to the apparatus frame structure 26 with a washing station lift mechanism 38 or may be separate from the frame structure 26. The illustrative washing station 16 is operable to wash and dry exterior surfaces of the objects 14. This washing may be achieved by applying a cleaning solution to the surfaces of the objects 14. The cleaning solution may be pressurized streams of water, a detergent, a combination thereof, and/or any other suitable substance which may be used to clean the surfaces of the objects 14. Cleaning may also be achieved using mechanisms other than streams of pressurized liquids and/or chemical agents. Cleaning may be carried out in a wide variety of ways including, for example, by wiping or brushing each object as an alternative to or in addition to cleaning each object with a liquid. Pressurized air may also be used to clean and/or dry each object at the washing station 16. The washing station may also operate to prepare surfaces on each object for an application of paint thereto following or as an alternative to cleaning and drying.

The washing station 16 is mounted below the conveying mechanism 13. The washing station 16 is mounted on a lift station 38 for movement between a non-actuated or lower position (see FIG. 1) in which the objects 14 are spaced above the washing station 16 and an actuated or raised position (see FIG. 2) in which the objects 14 are disposed inside the washing station 16.

The painting station 18 is positioned beneath and adjacent a downstream portion 40 of the lower segment 30. The painting station 18 may be connected to the apparatus frame structure 26, such as with a painting station lift mechanism 42 as shown, or may be a separate component of the painting apparatus 10. The painting station 18 is generally operable to apply paint to some or all of the surfaces of each object 14. The painting station may be constructed to apply paint in a wide range of ways. For example, a painting station can be constructed so that the paint is applied to each object 14 by a powder coating operation, by a paint spraying operation (e.g., conventional paint spraying or electrostatic spraying), or by dipping operation. The illustrative embodiment utilized dipping to paint each object 14. However, it can be understood that while the particular painting station 18 selected to illustrate principles of the invention applies paint through a dipping operation, this is intended as an illustration of the invention only and is not intended to limit the scope of the invention.

The painting station 18 is mounted below the conveying mechanism 13. The painting station 18 is mounted on a lift mechanism 42 for movement between a non-actuated or lower position (see FIG. 1) in which the objects 14 are spaced above the painting station 18 and an actuated or raised position (see FIG. 2) in which the objects 14 are disposed inside the painting station 18. When the washing station 16 and the painting station 18 are both in their lower positions, the objects 14 can be moved in the downstream direction.

The heating station 20 is optional and may be disposed along an upstream portion 44 of the upper segment 28 of the conveyor mechanism 13. The washing station 16, the painting station 18, and the heating station 20 are arranged along the conveyor mechanism 13 such that objects 14 being conveyed on the conveyor mechanism 13 are first washed by the washing station 16, coated with paint by the painting station 18, and then subsequently dried by the heating station 20.

Figure 3:
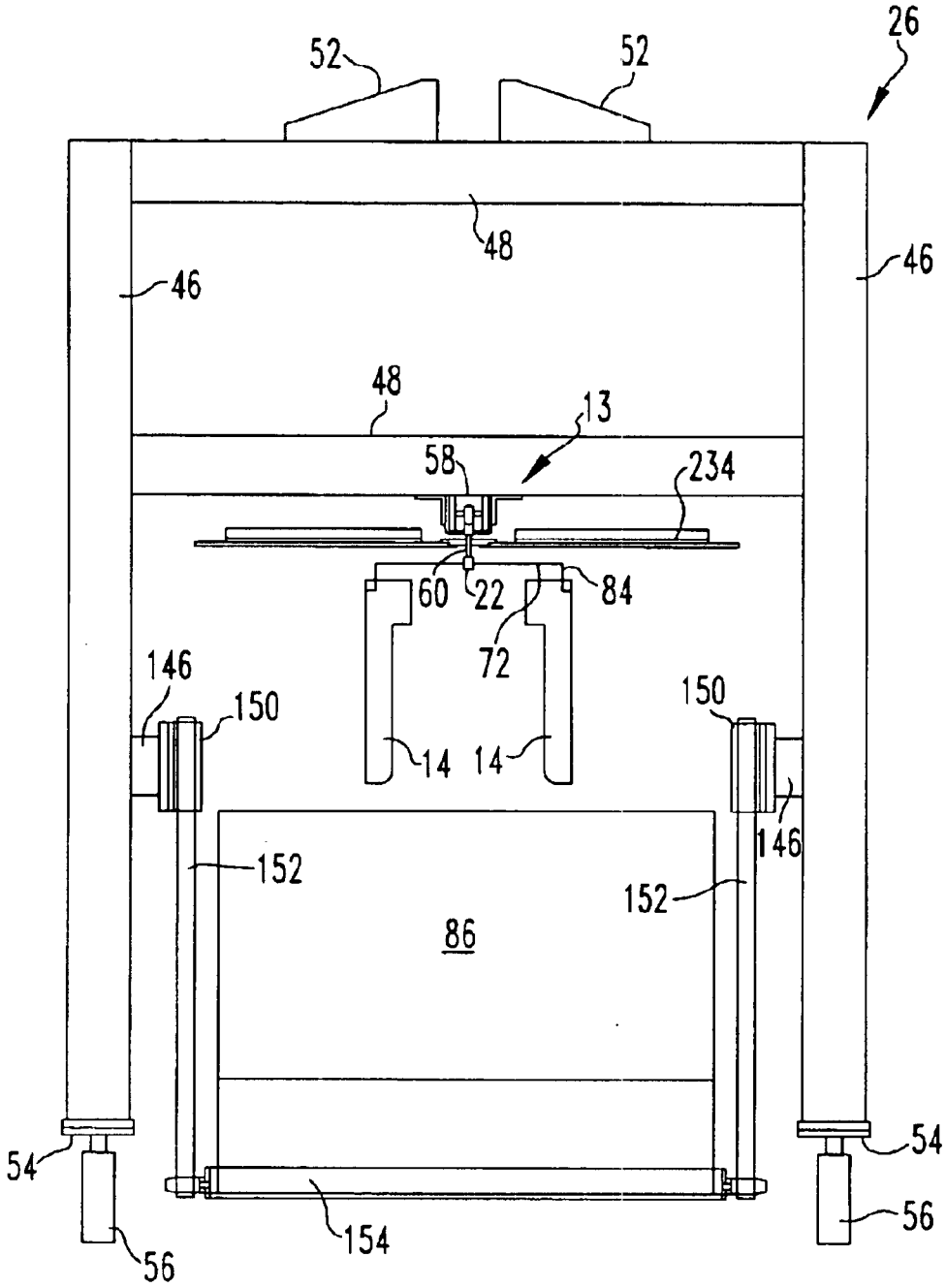
FIG. 3 is a front view of the painting apparatus of FIG. 1 with a conveyor thereof removed and not shown.

The apparatus frame structure 26 includes two pairs of laterally spaced vertical support structures 46 respectively interconnected by generally horizontally extending pairs of upper and lower cross pieces 48 (see FIG. 3, for example). The apparatus frame structure 26 includes a horizontal support member 50 attached to and interconnecting upper cross pieces 48 (see FIG. 1). The support member 50 extends between and is fixedly connected to side segments 32, 34 of the conveyor mechanism 13. The upper cross pieces 48 extend between respective pairs of vertical support structures 46 and include a pair of laterally spaced support brackets 52 that are generally designed to strengthen the connection between the cross pieces 48 and the horizontal support member 50. Each vertical support structure 46 preferably includes a caster 56 (which may include a releasable wheel locking mechanism or brake) so that the painting apparatus 10 is rollingly supported to enable the painting apparatus to be moved along a generally horizontal support surface, such as a floor.

The vertical support structures 46, the cross pieces 48, and the horizontal support member 50 are preferably formed of a tubular metal material, such as rectangular steel square tubing. Of course, any other suitable material and configuration thereof may be used and any suitable construction for the frame structure 26 may likewise be used.

Figure 3A:
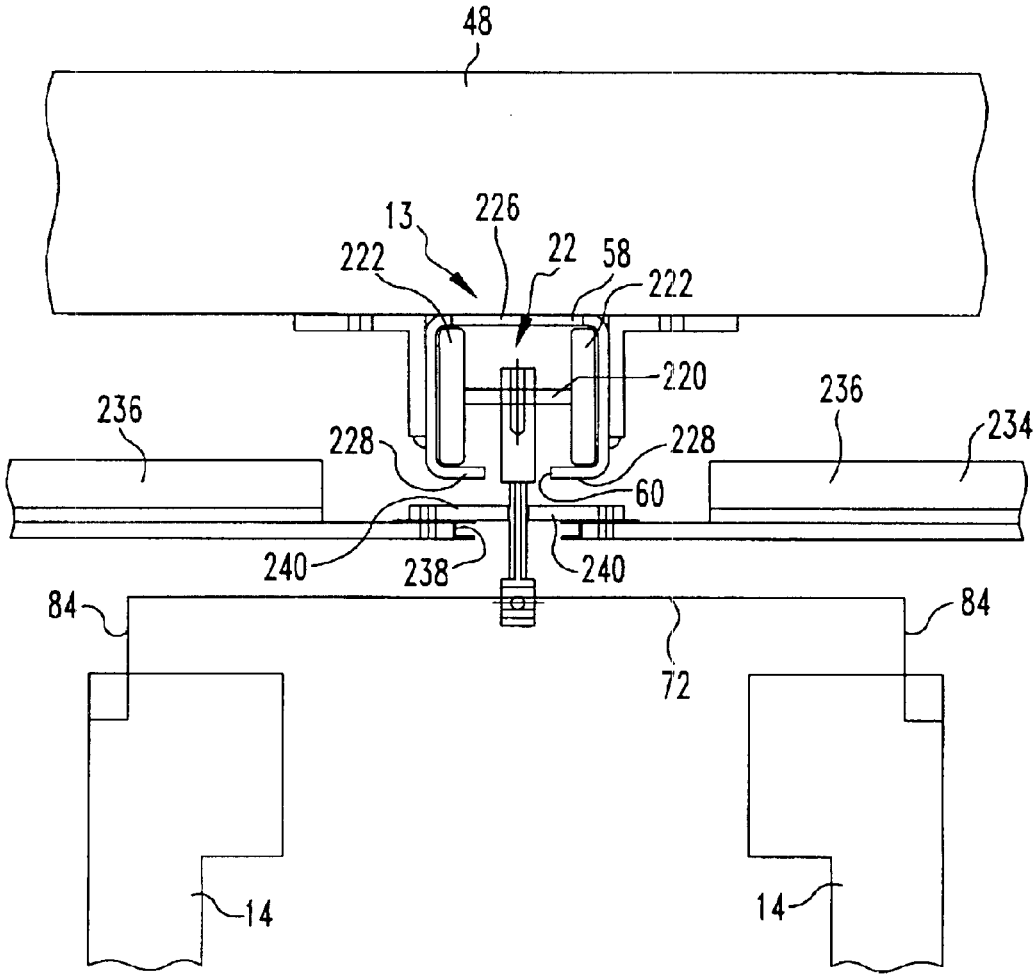
FIG. 3A is an enlarged view of a portion of the painting apparatus as shown in FIG. 3.

The conveyor mechanism 13 includes a track structure 58 that has a generally C-shaped cross-section (see, for example, FIGS. 3 and 3A). The track structure 58 is arranged such that a slot 60 formed therein faces generally radially outwardly relative to the looped configuration of the conveyor mechanism 13. The attachment structures 22 are connected to corresponding roller structures 220 (see FIG. 3A). Each roller structure 220 includes a pair of spaced roller elements 222 linked by a shaft element 224. The attachment structures 22 are mounted on mid-portions of the respective shaft elements 224. The roller elements 222 are disposed between an interior (relative to the looped configuration of the conveyor mechanism 13) wall member 226 and corresponding exterior wall member portions 228. Confronting end portions of the wall member portions 228 define the slot 60.

Figure 3B:
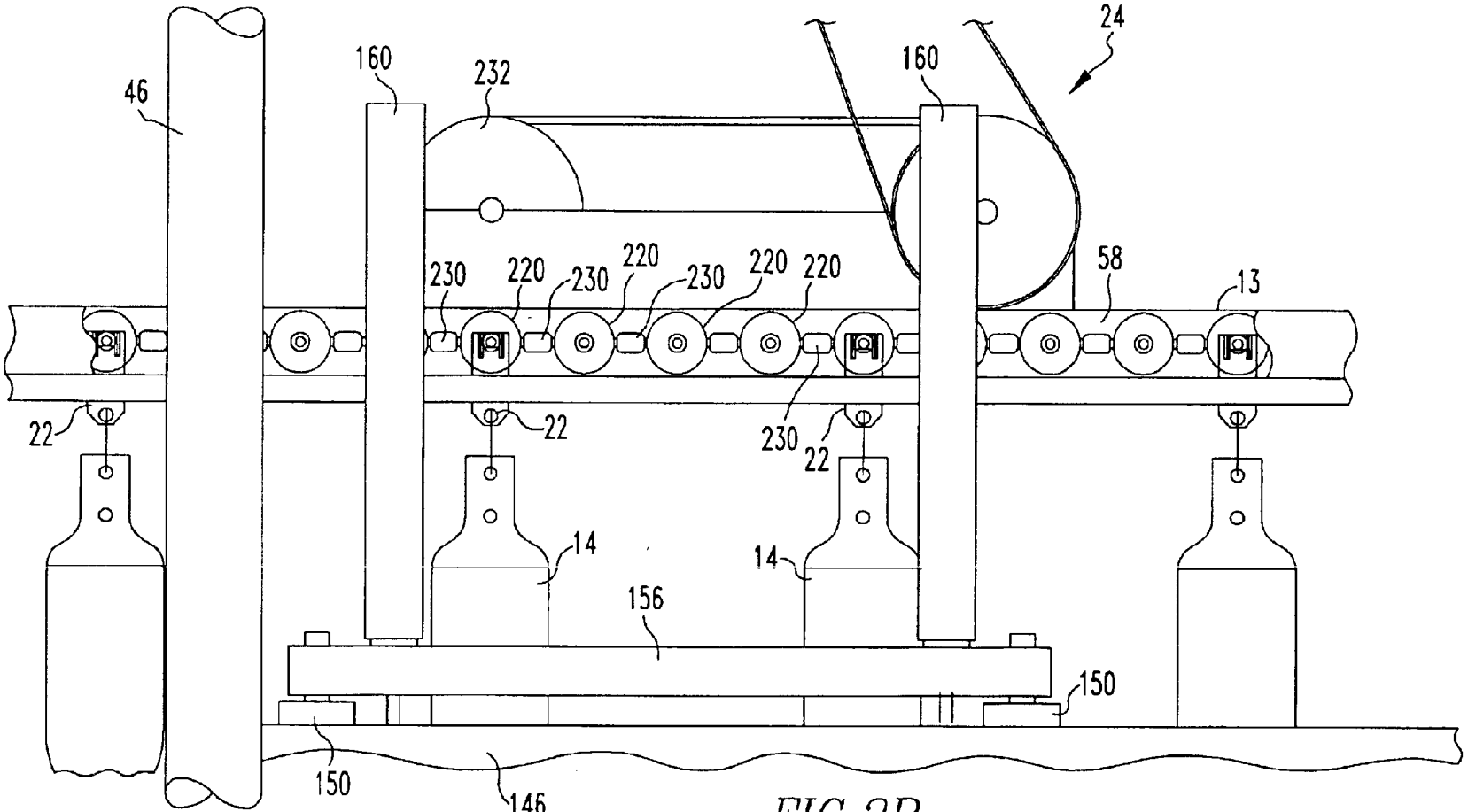
FIG. 3B is an enlarged view of a portion of the painting apparatus as shown in FIG. 1.

The conveyor mechanism 13 includes a plurality of roller structures 220 interlinked to one another with linkage structures 230 (see FIG. 3B). The drive assembly 24 includes a drive wheel 232 that is driven by the motor 25. The drive wheel 232 is in driving engagement with the roller structures 220 and/or the linkage structures 230.

It is contemplated that a standard conveyor line of a type commercially available from Rapid Industries, Inc. may be used to constitute the conveyor mechanism 13. However, this type of standard conveyor line is conventionally meant for horizontal conveyors. Accordingly, the track structure 58 may be customized to allow for the upstanding configuration of the conveyor mechanism 13.

Figure 3C:
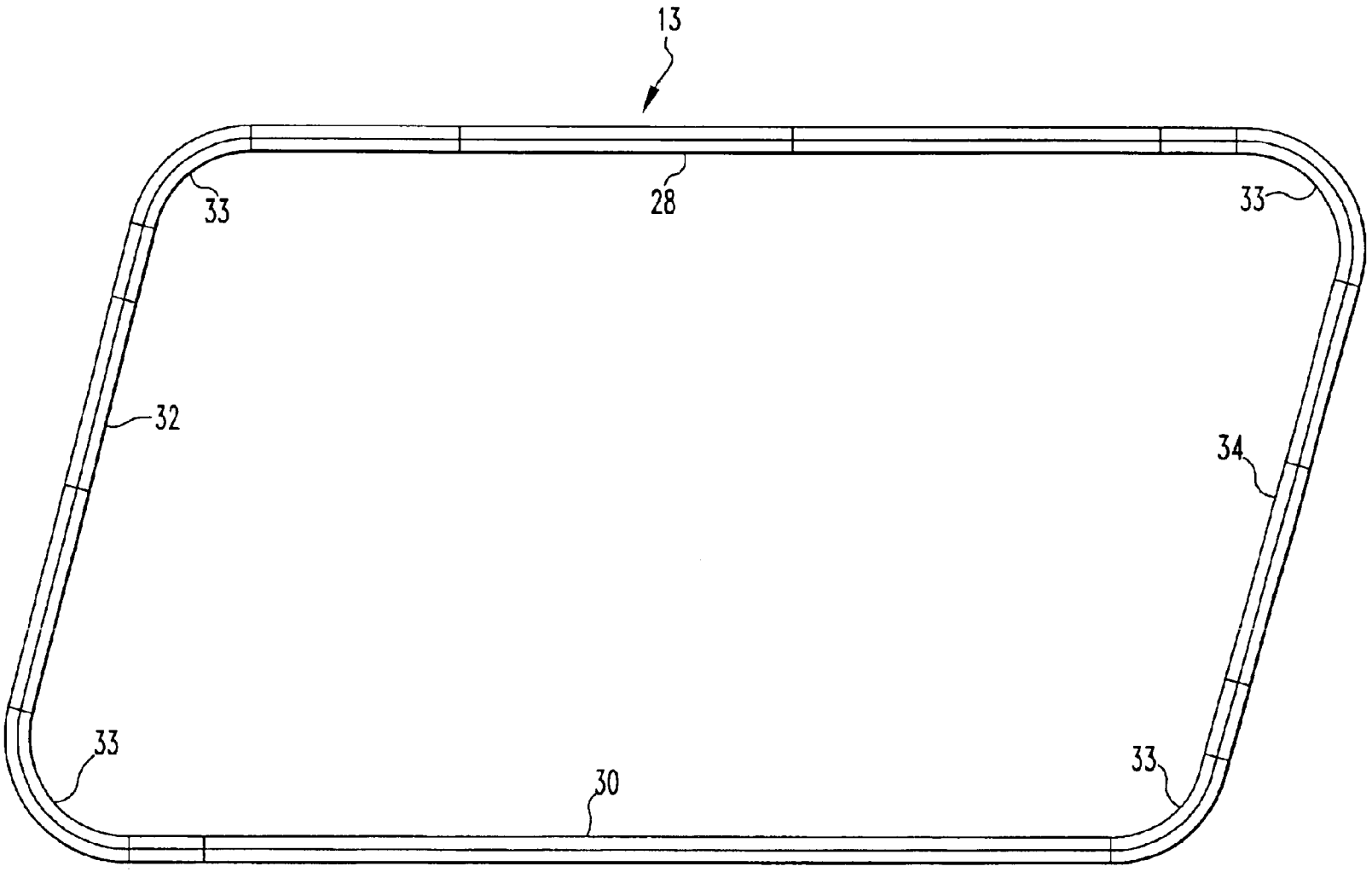
FIG. 3C is a side view of a conveyor structure of the painting apparatus.

FIG. 3C shows a contemplated configuration of the track structure 58. In particular, substantially straight segments of track may be used for the upper flight or segment 28, lower flight or segment 30, and side flights or segments 32, 34. Intersecting portions 33 of the track structure 58 are shaped to provide a desired curvature of the track structure 58. It may be preferable that each of the intersecting portions 33 be formed to have a radius of curvature that is sufficiently large to allow the interconnected roller structures 220 to relatively easily traverse the intersecting portions 33 (e.g., a radius of approximately one (1) foot may be used in one preferred embodiment of the painting apparatus, for example). Any suitable construction or configuration for the conveyor mechanism 13 may be used, however. The track structure 58 may, in some embodiments of the invention, generally be in the form of a parallelogram. That is, each of the opposite sides 28, 30 and 32, 34 of the track structure 58 may be generally parallel to one another.

Figure 5:
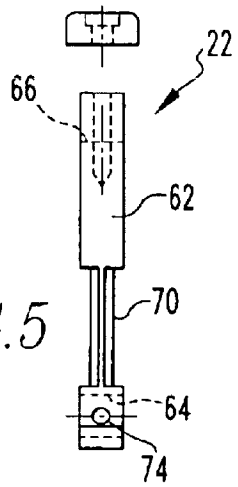
FIGS. 4 and 5 are front and side plan views, respectively, of an attachment structure of the painting apparatus.
Figure 4:
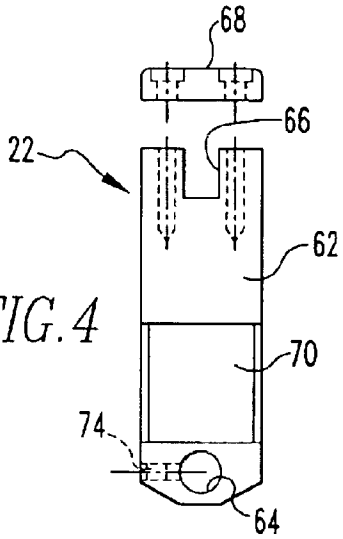

FIGS. 4 and 5 show an attachment structure 22 in isolation. As shown, each attachment structure 22 includes a substantially flat body portion 62 having a circular opening 64 formed within one end thereof and a rectangular opening 66 formed within an opposite end thereof. A retaining member 68 (shown in exploded relation to the body portion 62 in FIGS. 4 and 5) is detachably connectable to the body portion 62 on the end thereof corresponding with the rectangular opening 66 via a pair of fasteners (not shown).

Figure 6:
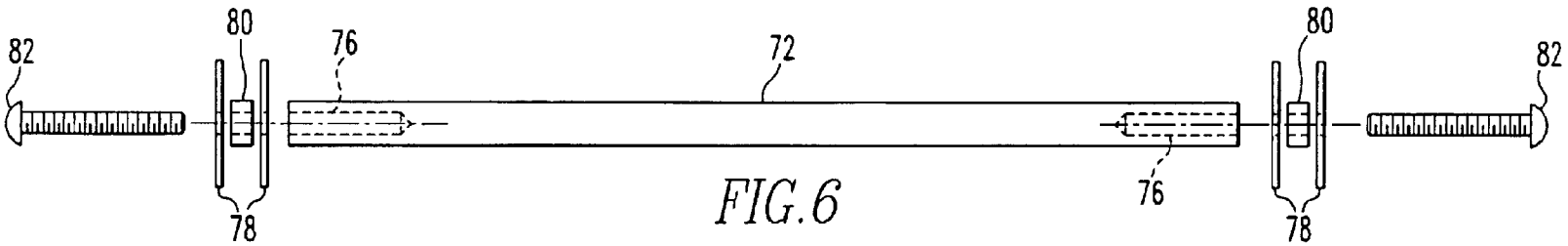
FIG. 6 is a plan view of an attachment bar of the painting apparatus.

The opening 66 receives therein the shaft element 224 of the corresponding roller structure 220 on which the attachment structure 22 is mounted (see FIG. 3A). The body portion 62 includes a narrowed portion 70. An attachment bar 72 (see FIG. 6) is received within the circular opening 64 and is secured therein with, e.g., a set screw (not shown) threadedly secured within a threaded opening 74 within the body portion 62.

The attachment bar 72 has an elongated configuration and includes axially inwardly extending threaded apertures 76 within each end thereof. A pair of retaining elements 78 and a spacer 80 disposed therebetween are secured to each axial end of the attachment bar 72 via a pair of threaded fasteners 82 which threadedly engage with threaded apertures 76. The attachment structures 22 extend laterally or transversely outwardly from the conveyor mechanism 13 (see FIG. 3).

FIG. 3 shows the lower segment 30 of the conveyor mechanism 13. The attachment structures 22 extend downwardly from the conveyor mechanism 13 along the lower segment 30. FIG. 3 illustrates an attachment bar schematically at 72. Each attachment bar 72 extends laterally outwardly from the respective attachment structure 22 such that ends thereof are disposed laterally outwardly of the conveyor mechanism 13. Hook structures 84 (see FIG. 3) are connected to respective ends of the attachment bar 72. Each hook structure 84 is configured to support an object 14 at a respective end of the attachment bar 72. The construction and arrangement of the attachment structures 22 and the hook structures 84 are illustrative only and are not be intended to limit the scope of the invention. Any suitable construction may be used to construct the attachment structures 22, the hook structures 84 and the associated structures.

The washing station 16 may be in the form of an enclosed structure as in the illustrative embodiment or, alternatively, may refer to a general region or area along the length of the looped conveyor where cleaning and/or drying and/or surface preparation is carried out. Similarly, the painting station 18 may be in the form of a partially or completely enclosed structure (as in the illustrative embodiment) or may simply refer to a general region or area along the length of the looped conveyor where painting is carried out. The heating or drying station 20 may be operable to partially or completely dry the paint on all or some of the surfaces of each object. The heating station 20 may be in the form of a partially or completely enclosed structure or may simply refer to a general region or area along the length of the looped conveyor where heating and/or drying and/or further treatment of the painted surfaces is carried out.

The washing station 16 and the heating station 20 are optional and may not both be included in some embodiments of the invention. Generally, the objects 14 are processed (that is, subjected to one or more operations which may include, for example, washing, rinsing, drying, surface preparing, painting and/or further drying) by removably attaching each object 14 to the conveyor assembly, moving the objects sequentially to each station, stopping the objects at each station, processing each object at each station, then moving each object to the next station until the processing is complete. This is illustrative only, however, and not intended to limit the scope of the invention. For example, in other embodiments of the invention, the processing may be carried out while the objects are moving. That is, although it is preferred to stop each object as each station 16, 18, 20 for processing, it is not necessary and processing may be carried out and completed while the objects are in continuous motion in the downstream direction.

Figure 7:
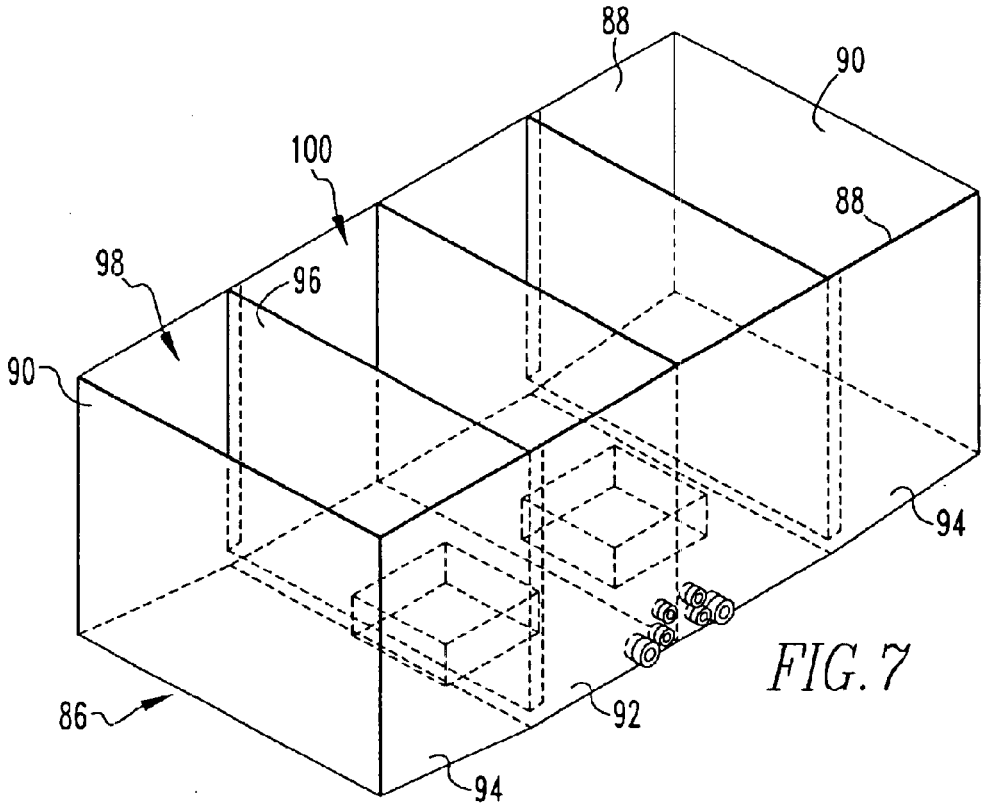
FIGS. 7 and 8 are schematic views of a washing receptacle structure of the painting apparatus.
Figure 8:
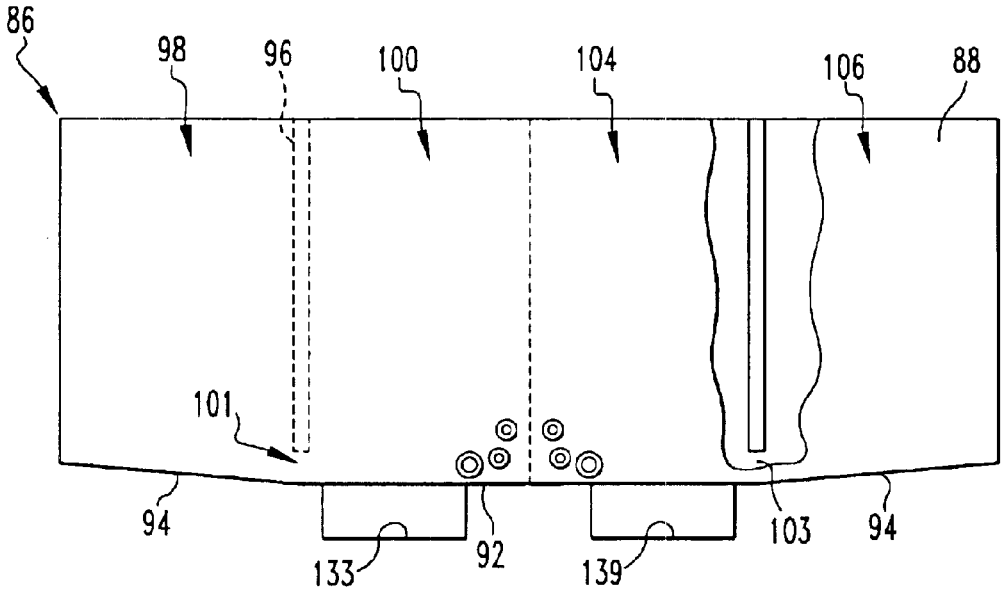

The washing station 16 may include a washing receptacle structure 86 (see FIGS. 7 and 8, for example). The washing receptacle structure 86 includes a pair of laterally spaced upstanding side wall members 88 which are interconnected at ends thereof with upstanding wall members 90. A bottom of the washing receptacle structure 86 is provided by central bottom wall member 92 which is generally horizontal and inclined bottom end wall members 94. A baffle wall member 96 defines a washing chamber 98 and a first drying chamber 100, which are in fluid communication with a common receptacle (e.g., a well 133 formed in the bottom of the washing chamber 98) so that excess fluid in each chamber is collected in the common receptacle. Specifically, the chambers 98, 100 are communicated with one another via a gap 101 between a lower edge of the baffle wall member 96 and the inclined bottom wall member 94 and fluid from both chambers flows into well 133.

The washing chamber 98 has disposed therein a washing structure 99 (FIGS. 9 and 10) for applying the cleaning solution to the surfaces of the objects 14 disposed therein. The baffle wall member 96 prevents cleaning solution from the washing chamber 98 from contacting the object 14 disposed within the first drying chamber 100.

The first drying chamber 100 has disposed therein a drying structure 101 operable to dry the object or objects disposed within the drying chamber 100 by, for example, applying or directing streams of air across the surfaces of each object 14 disposed therein so as to facilitate drying thereof.

The receptacle structure 86 includes a rinsing chamber 104. The rinsing chamber 104 includes a rinsing structure 105 therein to apply a rinsing solution to the surfaces of each object 14 disposed therein. The rinsing solution may be water, may be the cleaning solution, may be a combination thereof, or may be any substance suitable to further clean and/or rinse the objects, to facilitate removal of residual cleaning solution on the objects 14, and/or to prepare the surfaces of the objects 14 for painting.

The receptacle structure 86 also includes a second drying chamber 106. The rinsing chamber 104 and the second drying chamber 106 are in fluid communication with a common receptacle (e.g., a well 139) so that excess fluid in each chamber is collected in the common receptacle 139. Specifically, the chambers 104, 106 are in fluid communication with one another via a gap 103 between a lower edge of the baffle wall member 102 and the inclined bottom end wall member 94. The second drying chamber 106 includes a drying structure 107 therein to apply streams of air over surfaces of the objects 14 disposed therein. Cleaning and/or rinsing solution expelled from surfaces of the objects 14 within the chambers 98 and 106 is transmitted back to a respective chamber 100 104. In the illustrative embodiment, fluid removed from the surfaces of the objects 14 within the chambers 98, 106 falls onto a respective inclined bottom end wall member 94 and then flows through the gap 101, 103, respectively, between the baffle wall members 96, 102 and the respective inclined bottom end wall members 94 back into the chambers 100 and 104, respectively.

The washing receptacle structure 86 is generally movable between a non-actuated position in which the objects 14 are outside of the washing receptacle structure 86 and an actuated position in which the objects 14 are contained within the washing receptacle structure 86. In one preferred embodiment of the invention, the objects 14 are sealed within the washing receptacle structure 86 when the washing receptacle structure 86 is in its actuated position. Specifically, the washing station 16 includes a lid member 234 that is positioned to substantially enclose the washing receptacle structure 86, when the washing receptacle structure 86 is in its actuated position (see FIG. 2, for example).

The lid member 235 preferably has a sealing structure configured to engage a peripheral edge portion of the washing receptacle structure 86 in order to substantially prevent cleaning and/or rinsing solution from exiting the washing receptacle structure 86 when the objects 14 are enclosed within the washing receptacle structure 86. As shown in FIG. 3A, the lid member 234 may be provided by a pair of spaced lid portions 236. The lid portions 236 are spaced from one another so that the attachment structures 22 may extend through a gap 238 formed between the lid portions 236. The gap 238 allows the attachment structures 22 to move in the downstream direction with respect to the lid portions 236 when the washing receptacle structure 86 is in its non-actuated position.

It may be preferable for confronting edge portions of the lid portions 236 to have connected thereto seal structures 240 to substantially prevent the escape of cleaning and/or rinsing solution when objects 14 within the washing receptacle structure 86 are being washed, rinsed or dried. The seal structures 240 may be, for example, in the form of elongated flange-type seals constructed, for example, of a polymer or other suitable material, or may be in the form of a pair of bristle- or brush-type seals.

Figure 2:
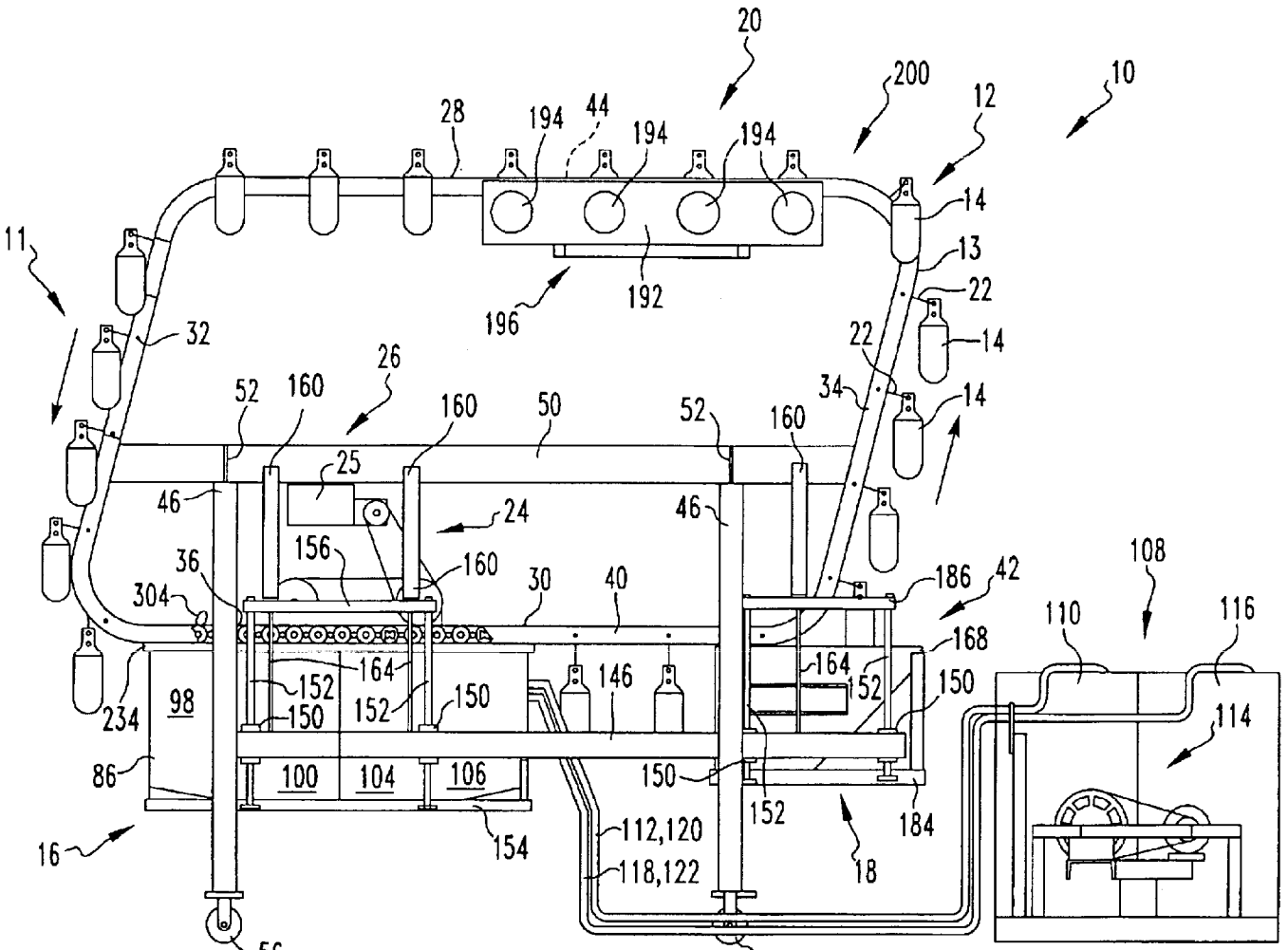

As shown in FIGS. 1 and 2, the painting apparatus 10 may include a remote washing or solution processing assembly 108. The washing processing assembly 108 is operable to supply and to re-circulate fluids (cleaning fluids, rinsing fluids, and so on) through the various chambers of the washing receptacle structure 86. The washing processing assembly 108 includes a pair of container structures 110, 116 within which volumes of the cleaning solution and rinsing solution are contained, respectively.

The cleaning solution is delivered from the container 110 via feed conduit 112 to the washing structure 99 within the washing chamber 98. A pump assembly 114 draws cleaning solution from the container 110 and delivers the same to the washing structure 99 via the feed conduit 112. The pump assembly 114 draws rinsing solution from the container 116 and delivers the same to the rinsing structure 105 via a feed conduit 118.

Figure 9:
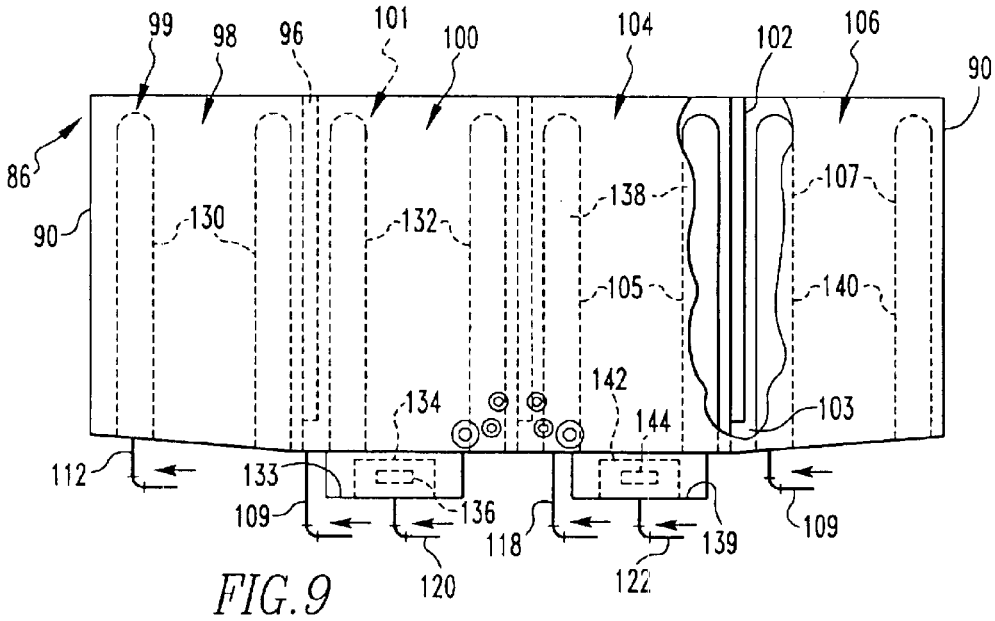
FIGS. 9 and 10 are schematic views of washing, rinsing, and drying chambers of the washing receptacle structure.
Figure 10:
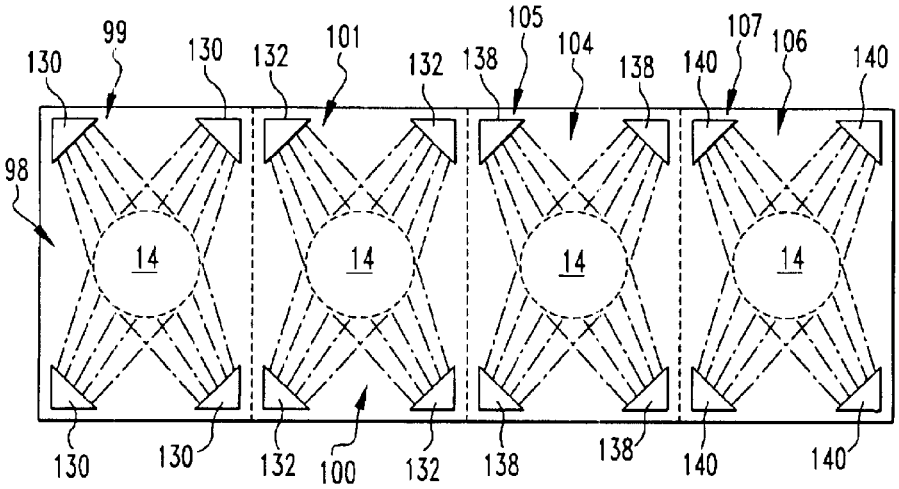

The drying structures 101, 107 may be supplied with compressed air from an air compressor (not shown) via an air delivery conduit 109 (FIGS. 9 and 10). As shown, the washing processing assembly 108 is not directly attached to the conveyor assembly 12. Accordingly, the conveyor assembly 12 may be moved without the necessity of moving the washing processing assembly 108. Additionally, the washing processing assembly 108 may be strategically positioned, such as near a power source or washing and rinsing solution reserves, while the conveyor assembly 12 is positioned strategically near, e.g., an end of an assembly line producing finished (but unpainted) products.

FIGS. 9 and 10 schematically show the washing receptacle structure 86 including the washing and rinsing structures 99, 105 and drying structures 101, 107. As shown, the washing structure 99 may include a plurality of spray manifolds, or spray bars 130. Each of the manifolds 130 is provided with a plurality of fluid delivery ports, which direct sprays of the cleaning solution onto surfaces of the object 14 disposed within the washing chamber 98. It is preferable for the ports to be arranged within the manifolds 130 such that the sprays overlap one another to ensure application of the cleaning solution over the entire object 14.

The drying structure 101 includes a plurality of manifolds 132, which each include a plurality of air ports. The air ports direct streams of air over the surfaces of the object 14 disposed within the first drying chamber 100 to remove excess cleaning solution therefrom applied within the washing chamber 98. Excess cleaning solution from the washing chamber 98 and communicated drying chamber 100 may be communicated back to the washing processing assembly 108.

For example, in the illustrative embodiment, excess cleaning solution from the washing chamber 98 and the drying chamber 100 accumulates within a bottom of the chamber 100. A sump pump 134 in the bottom of the drying chamber 100 is activated by a float mechanism 136 to return the accumulated cleaning solution back to the container 110 via return conduit 120 when a level of the accumulated cleaning solution reaches a predetermined height within a well 133 formed in the bottom of the washing chamber 98.

The rinsing structure 105 includes a plurality of spray manifolds, or spray bars 138. Each of the manifolds 138 is provided with a plurality of fluid delivery ports, which direct sprays of the rinsing solution onto surfaces of each object 14 disposed within the rinsing chamber 104. It is preferable for the ports to be arranged within the manifolds 138 such that the sprays overlap one another to ensure application of the rinsing solution over the entire object 14.

The drying structure 107 includes a plurality of manifolds 140, which each include a plurality of air ports. The air ports direct streams of air over the surfaces of each object 14 disposed within the second drying chamber 106 to remove excess rinsing solution therefrom that was applied to the object 14 when the object 14 was within the rinsing chamber 104. Excess rinsing solution from the rinsing chamber 104 and communicated drying chamber 106 accumulates within a well 139 in the bottom of the rinsing chamber 104. A sump pump 142 in the well in the bottom of the rinsing chamber 104 is activated by a float mechanism 144 to return the accumulated rinsing solution back to the container 116 via return conduit 122 when a level of the accumulated rinsing solution reaches a predetermined height within the well 139 of the rinsing chamber 104.

Figure 8A:
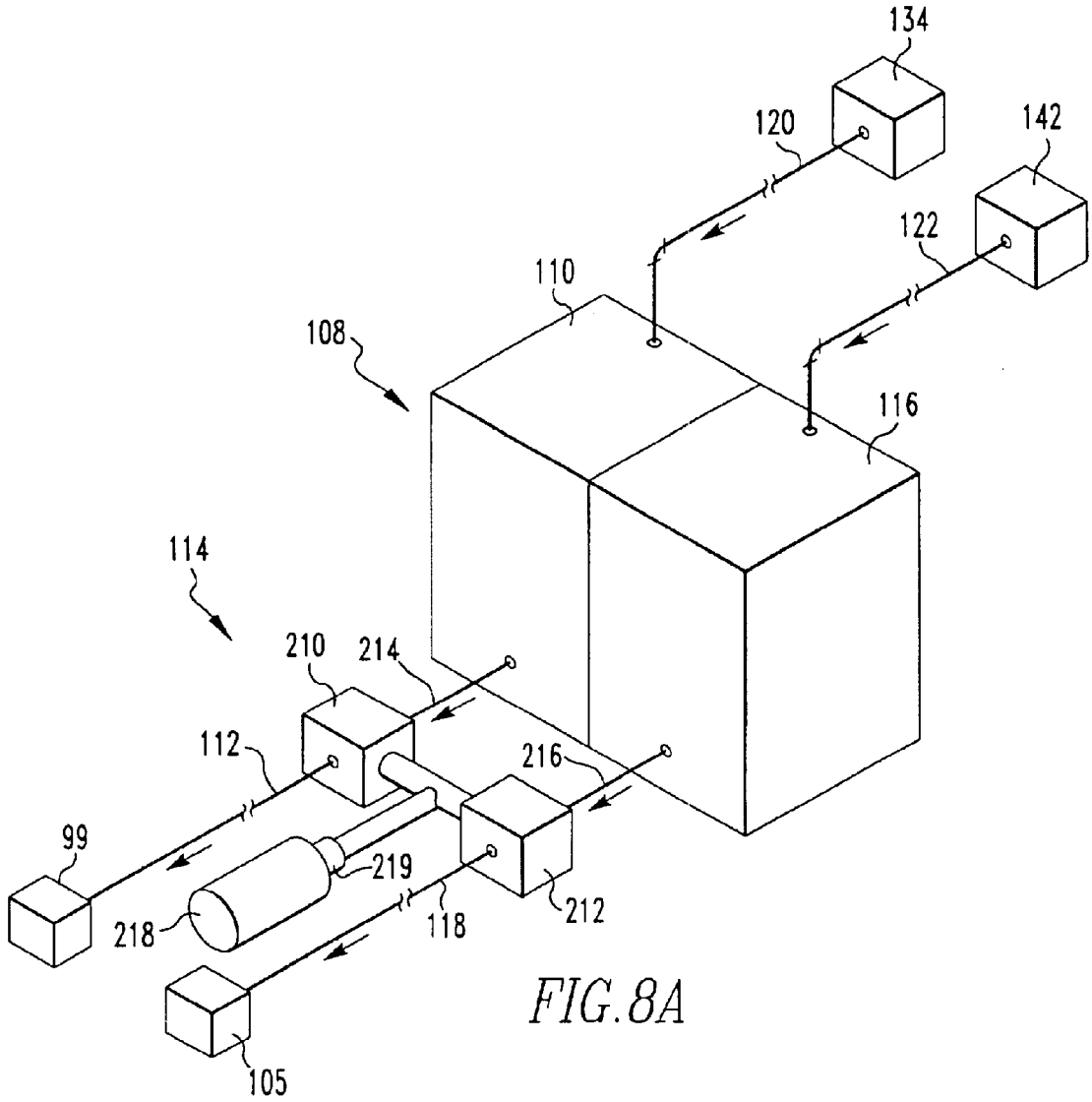
FIG. 8A is a schematic representation of a pump assembly and cleaning and rinsing solution circuits of the painting apparatus.

FIG. 8A schematically illustrates the solution processing assembly 108. As shown, the pump assembly 114 includes a pair of fluid pumps 210, 212, which are in fluid communication with respective containers 110, 116 via respective feed lines 214, 216. As illustrated, each of the pumps 210, 212 may be driven by an electric motor 218. It may be preferable for the pumps 210, 212 to be coupled to the electric motor 218 via a clutch mechanism (e.g., an air clutch) so as to allow selective operation of the pumps 210, 212.

The feed conduits 112, 118 are in fluid communication with respective pumps 210, 212 at first ends thereof and with the washing chamber 98 and rinsing chamber 104, respectively, on opposite ends thereof. Additionally, the return conduits 120, 122 are in fluid communication with respective containers 110, 116 on ends thereof opposite the sump pumps 134, 142, respectively. In this manner, cleaning solution and rinsing solution is supplied to the washing structure 99 and rinsing structure 105, respectively, via respective pumps 210, 212. Excess washing solution and cleaning solution are returned to the corresponding containers 110, 116 via the respective sump pump 134, 142. In this manner, the washing and rinsing solution circuits are effectively closed.

Referring to FIGS. 1 and 3, the apparatus frame structure 26 additionally includes a pair of side beam members 146, 148, which interconnect respective pairs of vertical support structures 46 on corresponding sides of the apparatus frame structure 26. The side beam members 146, 148 serve to provide additional rigidity and support to the apparatus frame structure 26 and, additionally, have slide members 150 mounted thereon. The washing station lift mechanism 38 includes opposing pairs of slide bars 152 which are coupled at lower ends thereof to a tray structure 154. The washing receptacle structure 86 is positioned on and supported by the tray structure 154. The slide bars 152 are slidably coupled to respective slide members 150 so as to allow relative sliding movement therebetween.

Figure 11:
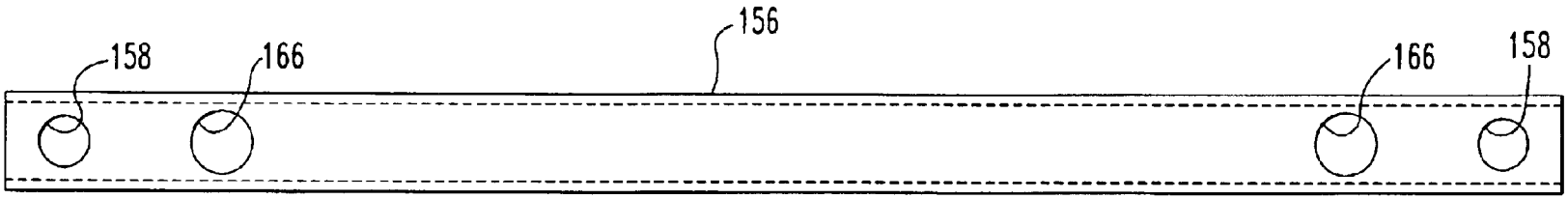
FIG. 11 is a top plan view of a lift bar of the painting apparatus.

As shown in FIG. 1, respective pairs of slide bars 152 are fixedly connected at upper ends thereof to opposite ends of a respective one of a pair of lift bars 156. As shown in FIG. 11, each lift bar 156 has openings 158 adjacent opposite ends thereof within which respective ends of the slide bars 152 are disposed. It is preferable for a connecting structure, such as a bolt or nut to secure to an upper end of each slide bar 152 so as to retain a relative positioning between the lift bars 156 and slide bars 152. Referring back to FIG. 1, the washing station lift mechanism 38 additionally includes opposing pairs of lift cylinders 160 connected between the lift bars 156 and the corresponding side beam members 146, 148.

Figure 12:
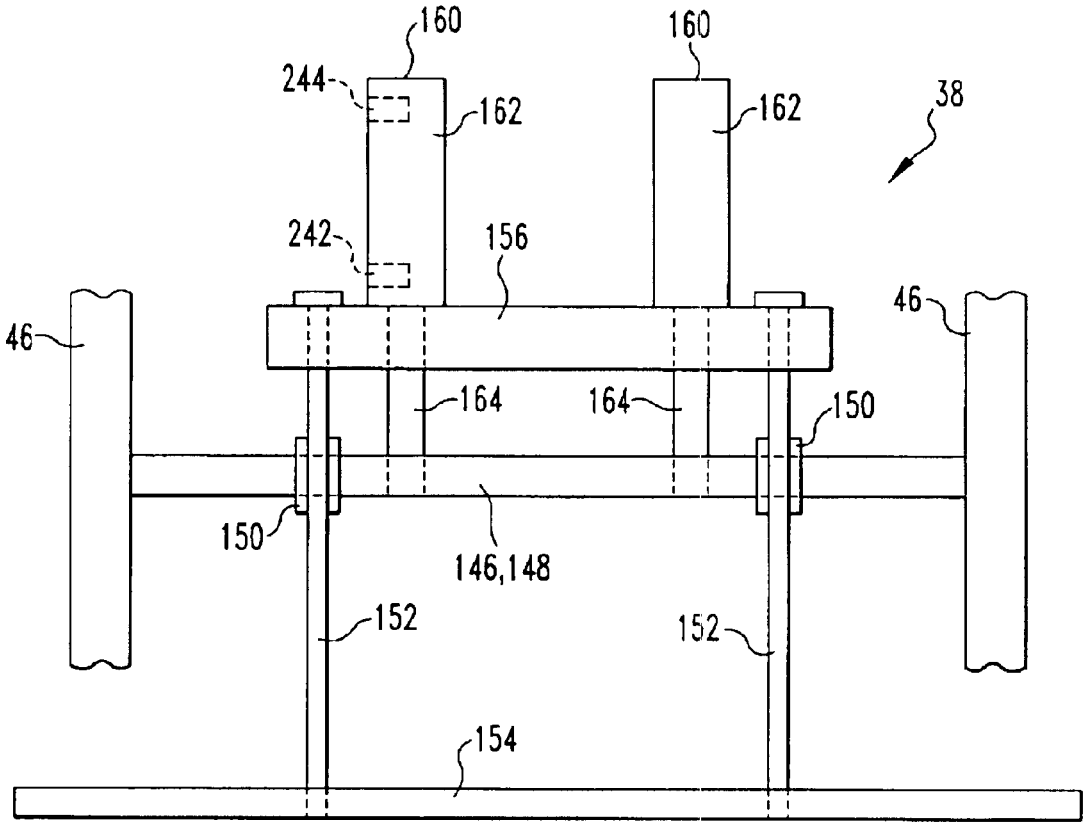
FIG. 12 is a schematic view of a washing station lift mechanism of the painting apparatus.

Each lift cylinder 160 includes an elongated cylinder body 162, a lower end of which is fixedly connected to the respective lift bar 156 (see FIG. 12). Each lift cylinder 160 also includes an axially movable piston rod 164, which extends through corresponding openings 166 within the lift bars 156. Outermost ends of the piston rods 164 are fixedly connected to corresponding side beam members 146, 148. The lift cylinders 160 may be of a pneumatic type (e.g., operated with a compressed gas) or may be of a hydraulic type (e.g., operated with a compressed fluid). In the instance in which the lift cylinders 160 are of the pneumatic type, the same compressor may used to supply compressed air both to the drying chambers 100, 106 and to the lift cylinders 160.

Extension of the piston rods 164 relative to the cylinder bodies 162 raises both the tray structure 154 and the washing receptacle structure 86. Likewise, retraction of the piston rods 164 relative to the cylinder bodies 162 lowers both the tray structure 154 and the washing receptacle structure 86. Preferably, at least one of the lift cylinders 160 is equipped with a pair of position sensors 242, 244 (which may be in the form of reed switches, for example) that respectively indicate when the washing receptacle structure 86 is in the non-actuated position and when the washing receptacle structure 86 is in the actuated position.

The illustrated construction for the washing station 16 and the construction of the lifting mechanism 38 are examples of the constructions of these features only and are not intended to limit the scope of the invention. Any suitable construction or configuration may be used.

Figure 13:
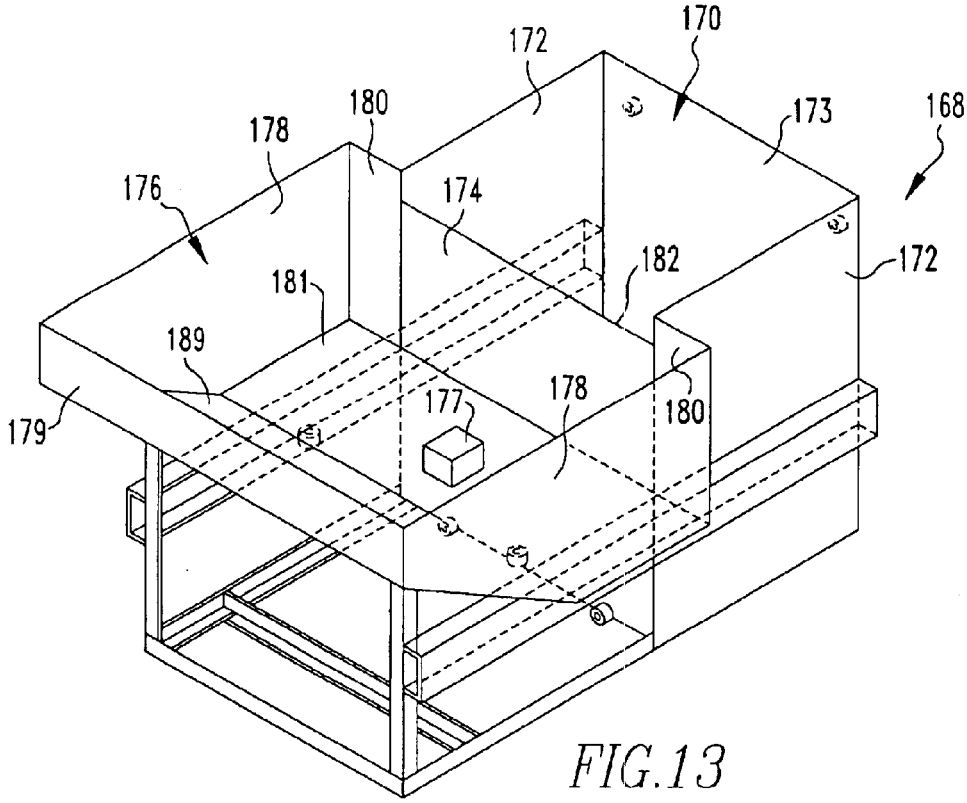
FIG. 13 is a perspective view of a paint reservoir structure.

The painting station 18 includes a paint reservoir structure 168 (see FIG. 1, for example). The paint reservoir structure 168 includes an upwardly opening paint reservoir 170 and a paint recollection receptacle 176. The paint reservoir 170 includes interconnected upstanding side wall members 172 and a back wall member 173 (see FIG. 13). The paint recollection receptacle 176 has a pair of side wall members 178, a pair of back wall members 180, a front wall 179 and a pair of bottom walls 181, 189.

A wall 174 separates the paint reservoir 170 from the recollection receptacle 176. An upper edge 182 of the wall member 174 of the paint reservoir 170 is disposed below a vertical extent of the wall members 172, 173, 178, 179, 180 to allow an amount of paint to flow from the reservoir 170 into the receptacle 176. It is preferable that the amount of paint disposed within the paint reservoir 170 be of a volume sufficient to flow over the upper edge 182 of the wall member 174 into the paint recollection receptacle 176. The paint recollection receptacle 176 includes a sump pump 177 that pumps paint collected within the paint recollection receptacle 176 back into the paint reservoir 170. The pump 177 can be operated to produce a continuous flow of paint between the reservoir 170 and the recollection receptacle 176.

Specifically, the pump 177 may be operated to produce a continuous paint flow from the paint reservoir 170, over the upper edge 182 of the wall 174 and into the paint recollection receptacle 176, and then back to the paint reservoir 170 via the sump pump 177. This constant circulation of paint between the reservoir 170 and the receptacle 176 prevents stagnation of the paint within the paint reservoir 170.

The paint recollection receptacle 176 extends in the conveying direction a distance at least equivalent to or farther than a horizontal extent of the second side segment 34 of the conveyor mechanism 13 (see FIG. 1). In this manner, excess paint which may drip from objects 14 positioned along the side segment 34 is captured within the paint recollection receptacle 176. Subsequently, the captured paint is returned to the paint reservoir 170 by the sump pump 177.

As illustrated in FIGS. 1 and 2, the painting station lift mechanism 42 is capable of raising the paint reservoir structure 168 such that an object disposed above the paint reservoir 170 is immersed within the volume of paint disposed within the paint reservoir 170 as the paint reservoir structure 168 is raised. Lowering the paint reservoir 168 serves to withdraw the object 14 from the paint disposed therein.

The painting station lift mechanism 42 is similar to the washing station lifting mechanism 38. However, it may include only a single pair of lift cylinders 160. The painting station lift mechanism 42 also includes opposing pairs of slide bars 152 which are coupled at lower ends thereof to a tray structure 184.

Figure 14:
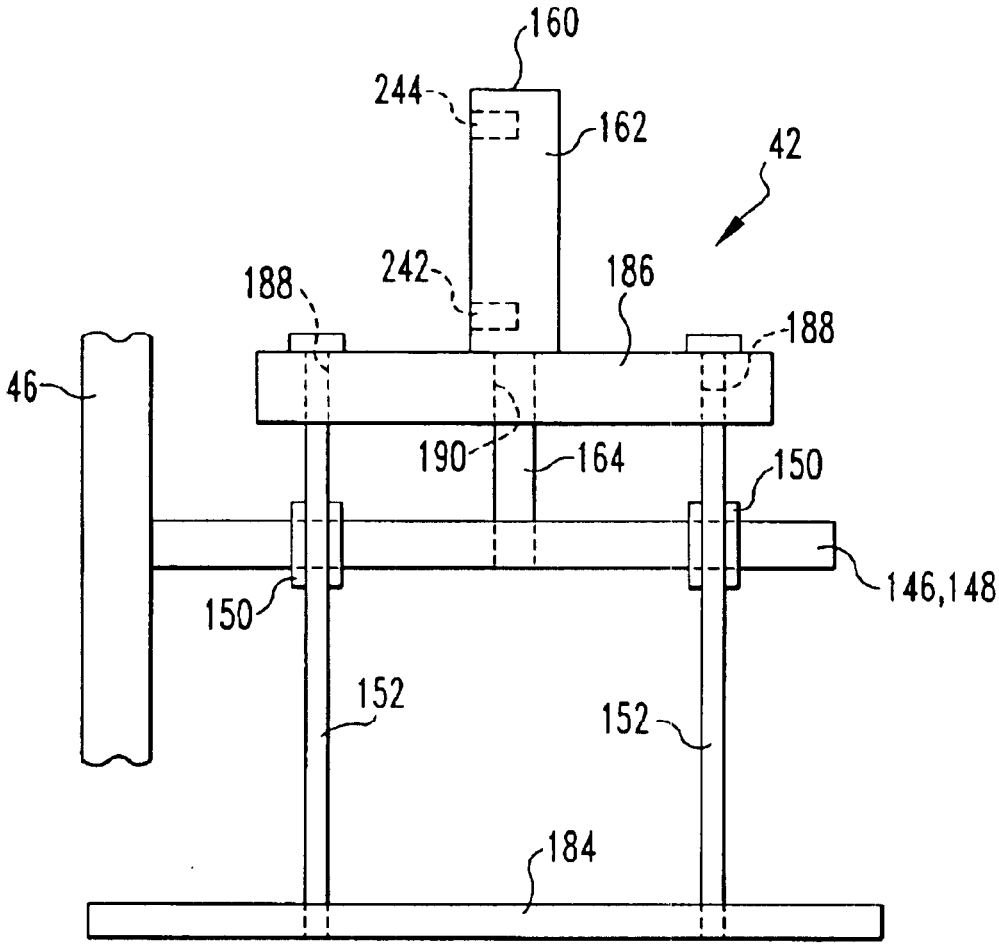
FIG. 14 is a schematic view of a painting station lift mechanism of the painting apparatus.
Figure 15:
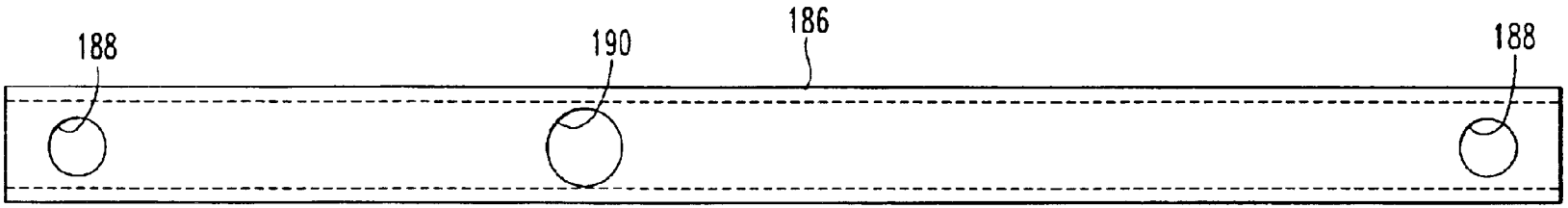
FIG. 15 is a top plan view of another lift bar of the painting apparatus.

The paint reservoir structure 168 is positioned on and supported by the tray structure 184. The slide bars 152 are slidably coupled to respective slide members 150 to allow relative sliding movement therebetween. Respective pairs of slide bars 152 are fixedly connected at upper ends thereof to opposite ends of a respective one of a pair of lift bars 186 (see FIG. 14). Each lift bar 186 has openings 188 adjacent opposite ends thereof within which respective slide bar ends are disposed (see FIG. 15). It is preferable for a connecting structure (e.g., a bolt or nut) to secure to an upper end of each slide bar 152 so as to retain a relative positioning between the lift bars 186 and slide bars 152.

The painting station lift mechanism 42 includes a pair of laterally spaced lift cylinders 160 connected between the lift bars 186 and the corresponding side beam members 146, 148 (see FIG. 1). The piston rods 164 of the lift cylinders 160 extend through corresponding openings 190 within the lift bars 186 (see FIG. 14). Outermost ends of the piston rods 164 are fixedly connected to corresponding side beam members 146, 148.

The lift cylinders 160 may be of a pneumatic type (e.g., operated with a compressed gas) or of a hydraulic type (e.g., operated with a compressed fluid). In the case wherein the lift cylinders 160 are of the pneumatic type, the same compressor used to supply compressed air to the drying chambers 100, 106 may be used to operate the lift cylinders 160.

Extension and retraction of the piston rods 164 relative to the cylinder bodies 162 raises and lowers the tray structure 184 and the paint reservoir structure 168. Preferably, at least one of the lift cylinders 160 is equipped with a pair of position sensors 246, 248 (which may be in the form of reed switches, for example) that respectively indicate when the paint reservoir structure 168 is in the home (lowered) position and when the paint reservoir structure 168 is in the raised position.

The illustrated construction for the painting station 18 and its lifting mechanism 42 is only an example and is not intended to limit the scope of the invention. Any suitable construction or configuration may be used.

The drying station 20 is operable to dry each object 14 partially or completely. The drying station 20 may include, for example, a pair of laterally spaced confronting heating structures 192 arranged relative to the conveyor mechanism 13 such that objects 14 are conveyed between and past the heating structures 192 to effect drying of the objects 14. In one illustrative embodiment of the invention, the heating structures 192 include a series of infrared heaters 194 which can emit both heat and infrared radiation to facilitate drying and/or curing of the paint on the objects 14.

Figure 16:
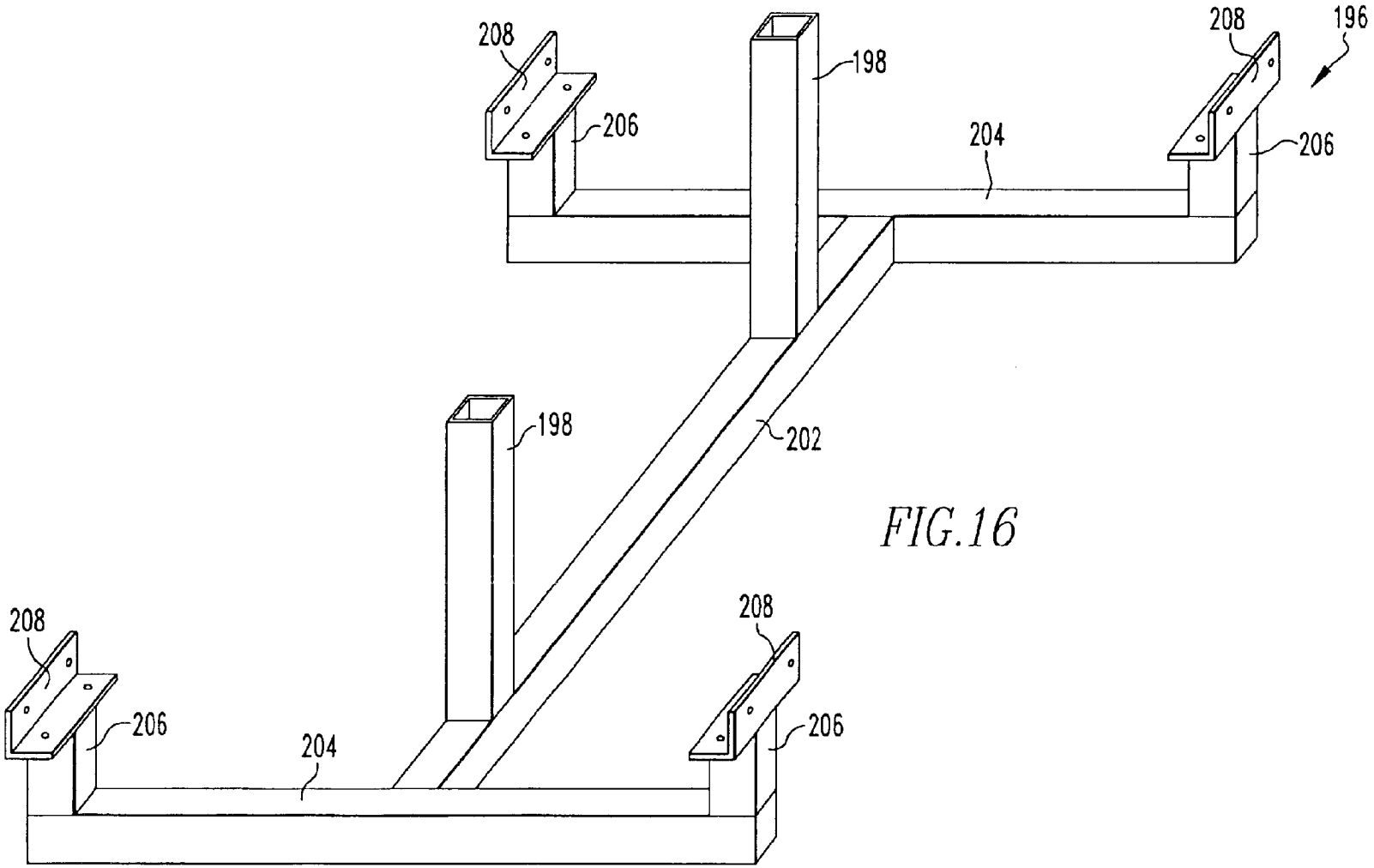
FIG. 16 is a perspective view of a support structure of the drying station.

FIG. 16 shows a support structure 196 used to secure the heating structures 192 to the conveyor mechanism 13. The support structure 196 includes a pair of depending support members 198 that are fixedly connected to undersides of the conveyor mechanism 13 at an upstream portion 200 of the upper segment 28 of the conveyor mechanism 13. A cross bar 202 is connected to each of the support members 198 and extends outwardly therepast. Mounting rails 204 are connected to respective ends of the cross bar 202 at midpoints thereof. Connecting portions 206 are connected to respective ends of the mounting rails 204 in upstanding relation thereto. Upper ends of the connecting portions 206 include mounting brackets 208 that are connected to the heating structures 192 via fasteners (not shown). Any other suitable components and/or construction for the drying station 20 may be used in place of the illustrated example.

Figure 17:
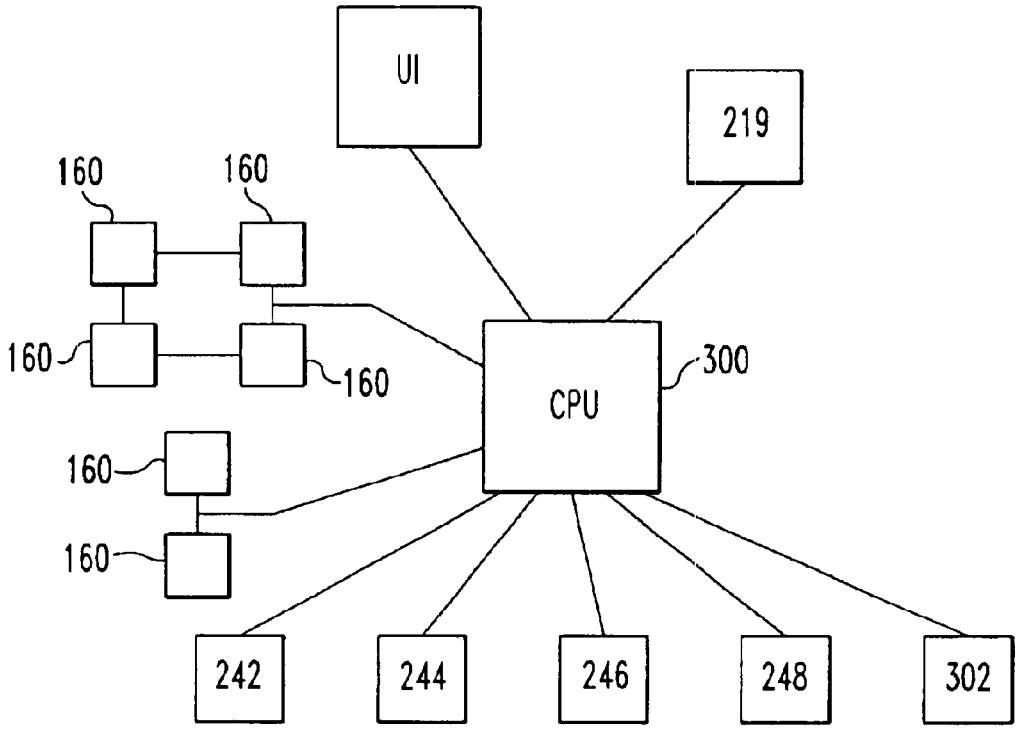
FIG. 17 is a schematic view of an illustrative embodiment of a control system of the painting apparatus.

The painting apparatus 10 preferably includes an electronic control system that includes a programmable microprocessor or central processing unit (CPU) 300, schematically illustrated in FIG. 17. The control system is operable to control the operation of the washing and painting apparatus 10 including the operation of the conveyor mechanism 13, the washing station 16, the painting station 18 and the drying station 20.

The CPU 300 is electrically communicated to the air clutch 219 and can be programmed to control the operation of the air clutch 219 to thereby initiate and cease fluid delivery to the washing station 16. The CPU 300 can also be programmed to control the lift cylinders 160. The CPU may be is electrically communicated with the lift cylinders 160 (via, e.g., solenoid valves) to effect extension and retraction thereof. The CPU 300 can be programmed and operated to extend and retract of any of the lift cylinders associated with either of the washing and painting stations 16, 18. Specifically, to raise the washing station 16, the CPU 300 can command the two pairs of lift cylinders 160 supporting the washing station 16 to extend and, to raise the painting station 18, the CPU 300 can command the pair of lift cylinders 160 supporting the painting station 18 to extend. The CPU 300 is also in electrical communication with the position sensors 242, 244, 246, 248. The position sensors 242, 244, 246, 248 can provide feedback signals to the CPU 300 to indicate the position of the washing station 16 and the painting station 18. Preferably the conveyor 300 includes a hook sensor 302 (see FIGS. 1 and 2) operable to and configured to send signals to the CPU 300 to indicate the position of the attachments structures 22 to enable the CPU 300 to determine when the attachment structures 22 are in the corresponding incremental positions.

Figure 18A:
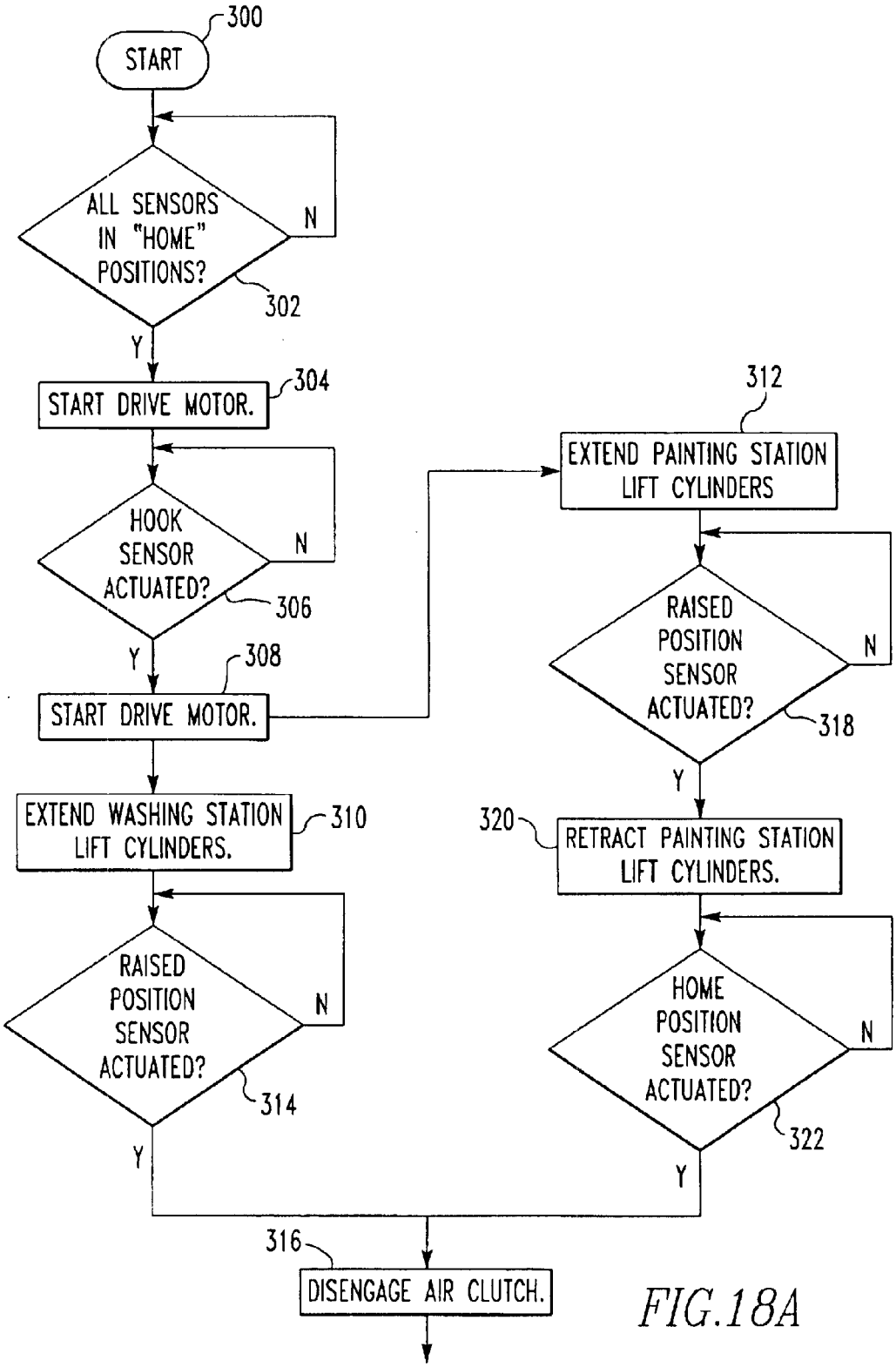
FIGS. 18A and 18B is a flow chart illustrating an example of a sequence of control operations for controlling the painting apparatus.

An example method of operation is described herein below with reference to FIGS. 18A and 18B. As shown in FIG. 18A, the method starts at 300 and proceeds to 302 where it is determined whether or not sensors 242–248 and 302 indicate that the washing station 16 and painting station 18 are in their non-actuated (or lowered or "home") positions and that the attachment structures 22 are in desired locations, respectively. If not (N), the determination repeats until a yes (Y) determination is made.

When the yes (Y) determination is made, the method proceeds to command 304, which starts the drive motor 25 to convey the objects 14 to the next incremental positions. Upon activation of the drive motor 25, the method proceeds to determination 306 which determines if the hook sensor 302 is actuated. If not (N), the determination repeats until a yes (Y) determination is made.

When the yes (Y) determination is made by actuation of the hook sensor 302, the method proceeds to command 308, which stops the drive motor 25. At this point, the objects 14 have been indexed to the subsequent incremental positions. After command 308, the method proceeds to commands 310 and 312. At the commands 310, 312 the lift cylinders 160 are extended to lift the washing station 16 and the painting station 18 to their actuated positions.

At 314, it is determined if the position sensor 244 indicates that the washing station 16 is in its raised position. If not (N), the determination is repeated until a yes (Y) determination is made. When the yes (Y) determination is made by actuation of the raised position sensor 244, the air clutch 219 is disengaged at 316. Simultaneously with command 310 and determination 314, determinations 318, 322 and command 320 are carried out.

Specifically, after command 312 is carried out, the method proceeds to determination 318, which determines if the raised position sensor 248 indicates that the painting station 18 is in its raised position. If not (N), the determination is repeated until a yes (Y) determination is made. When the yes (Y) determination is made by actuation of the raised position sensor 248, the method proceeds to command 320.

At command 320, the lift cylinders 160 supporting the painting station 18 are retracted so as to lower the painting station 18. The subsequent determination 322 determines when the painting station is in its non-actuated or lowered position. If the position sensor 246 indicates that the painting station 18 is not (N) in its non-actuated position, then the determination is repeated until a yes (Y) determination is made. When the yes (Y) determination is made by actuation of the position sensor 246, the method proceeds to command 316, discussed previously.

Figure 18B:
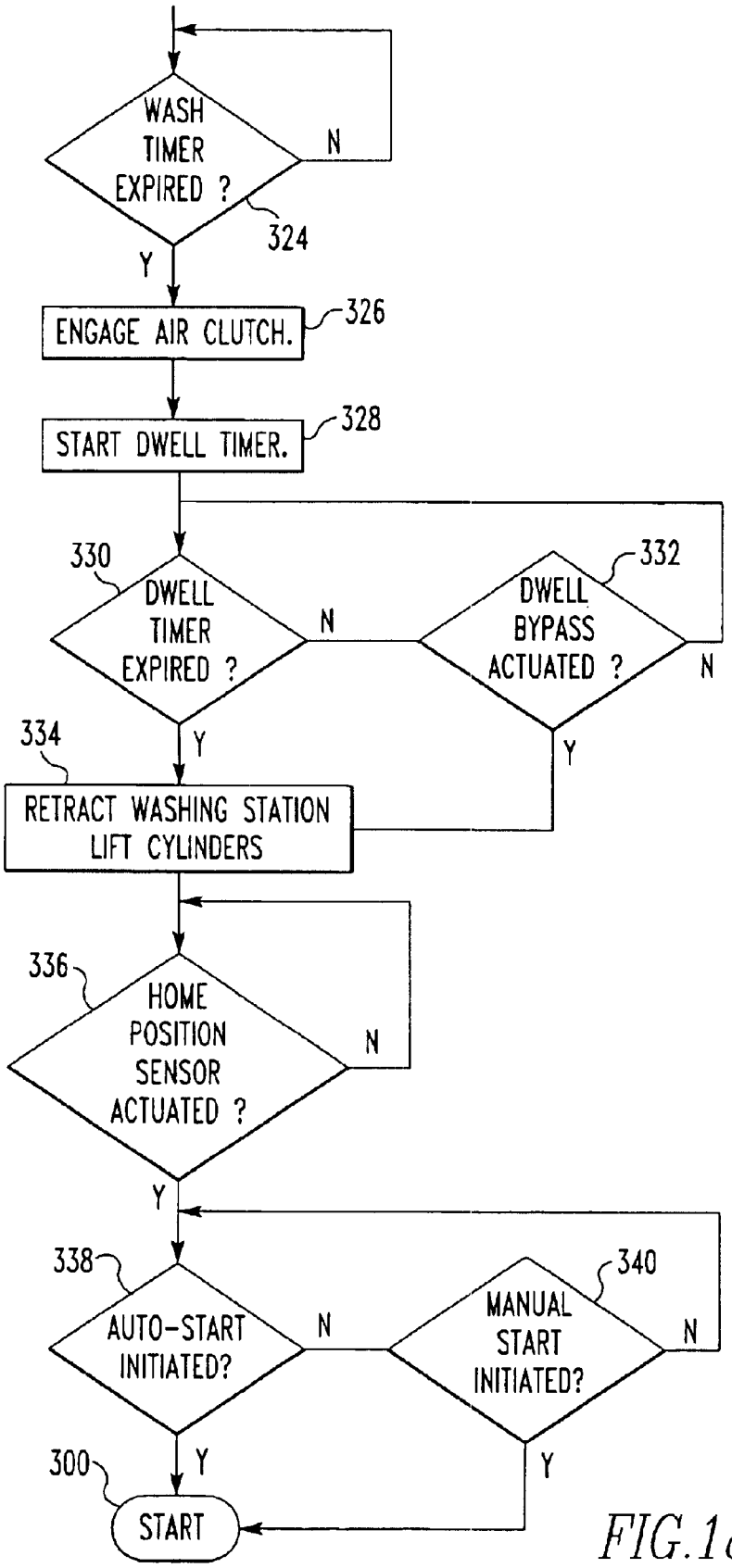

Referring to FIG. 18B, after the command 316 is carried out, the method proceeds to determination 324 where it is determined if a wash timer has expired. The wash timer is preferably of a sufficient duration to ensure proper cleansing/rinsing of the objects 14. It is contemplated that about 40 seconds may be sufficient. Of course, this duration may be altered depending on the specific configuration of the painting apparatus 10, the objects being cleaned, the type of cleaning/rinsing solution used, etc. The determination is repeated (N) until the wash time expires (Y).

The method proceeds to command 326, which engages the air clutch 219 to cease delivery of cleaning/rinsing solution to the washing station 16. Subsequent to command 326, a dwell timer is started at command 328. The dwell timer is preferably of sufficient duration to ensure adequate drying of paint on the objects 14 disposed within the drying station 20 and to allow the user sufficient time to remove painted and dried objects from the conveyor mechanism 13 and to re-attach uncleaned, unpainted objects to the conveyor mechanism 13. It is contemplated that about 80 seconds may be sufficient. Of course, the duration of dwell may vary. The dwell timer is run at determination 330.

It is contemplated that a dwell bypass may be provided with which the user may effectively short cycle (i.e., bypass) the dwell timer to proceed to the following command. Referring back to FIG. 17, a user interface (UI) is provided at 250 that is communicated with the CPU 300. It is contemplated that the user interface 250 may include an actuating structure or mechanism (e.g., button, switch, etc.) to allow the user to manually actuate the dwell bypass.

As shown in FIG. 18B, as the dwell timer runs at determination 330, the CPU 300 monitors the dwell bypass at determination 332. If the dwell bypass is not actuated, the dwell timer continues. If a yes (Y) determination is made at determination 332 indicating that the dwell bypass is actuated, the method proceeds to command 334 regardless of how much time is left on the dwell timer.

At the command 334, the lift cylinders 160 supporting the washing station 16 are retracted to lower the washing station 16 to its non-actuated position. The method then proceeds to determination 336 where it is determined if the position sensor 246 indicates that the washing station 16 is in its non-actuated position. If not (N), the determination repeats until a yes (Y) determination is made. When the yes (Y) determination is made by actuation of the position sensor 246, the method proceeds to determination 338.

The determination 338 determines if the painting apparatus 10 is in an auto-start mode. As shown, if it is determined that the auto-start is initiated (Y), the method then automatically proceeds back to start 300. It is contemplated that the user interface 250 may include an actuating structure or mechanism (e.g., button, switch, etc.) with which the user may initiate the auto-start mode. If it is determined at determination 338 that the auto-start is not initiated (N), the method proceeds to determination 340 where it is determined if the user has initiated manual start (Y) of the painting apparatus. It is contemplated that the manual start may be effected by use of an actuating structure or mechanism (e.g., button, switch, etc.) on the user interface 250. Until the user initiates one of manual start of the painting apparatus or auto-start, the method repeats determinations 338 and 340.

It is contemplated that, in lieu of repeating determinations until a yes (Y) determination is made, as described above, there may be provided a visual and/or audible signal to make the user aware of a possible error.

While the principles of the present invention have been made clear in the illustrative embodiments set forth above, it will be apparent to those skilled in the art that various modifications may be made to the structure, arrangement, proportion, elements, materials, and components used in the practice of the invention.

What is claimed is:

1. A washing and painting apparatus for washing and painting objects, comprising:

an apparatus frame structure;

an endless conveyor assembly mounted to said frame structure and including a conveyor, said conveyor having a series of incrementally spaced attachment structures thereon configured to secure the objects thereon for washing and painting, said conveyor being movable for moving said attachment structures between consecutive incremental positions along said frame structure in a downstream conveying direction, the distance between consecutive incremental positions being generally equal to an incremental spacing between consecutive attachment structures;

a washing station including a washing receptacle structure disposed beneath said conveyor and configured to apply a cleaning solution to objects disposed therein, and a washing station lift mechanism constructed to move said washing receptacle structure between (a) a raised position wherein said washing receptacle structure is raised upwardly to receive therein one of the objects which is in a washing incremental position so as to apply the cleaning solution to surfaces of the object and (b) a lowered position wherein said washing receptacle structure is disposed below a vertical extent of the object to thereby allow the object to be conveyed downstream from said washing incremental position;

a painting station including an upwardly open paint reservoir disposed beneath said conveyor downstream of said washing receptacle structure, said paint reservoir being configured to contain a volume of paint therein, said painting station further including a painting station lift mechanism constructed to move said paint reservoir between (a) a raised position wherein said paint reservoir is raised upwardly to receive therein one of the objects which is in a painting incremental position so as to dispose the object within the volume of paint and (b) a lowered position wherein said paint reservoir is disposed below the vertical extent of the object to thereby allow the object to be conveyed downstream from the painting incremental position; and a heating station including one or more heaters disposed along said conveyor downstream of said paint reservoir and being constructed to apply heat to one of the objects which is in a heating incremental position.

2. A washing and painting apparatus according to claim 1, wherein said conveyor is an upright closed loop conveyor.

3. A washing and painting apparatus according to claim 2, wherein said upright looped conveyor includes substantially horizontal upper and lower segments which are generally parallel to one another and first and second generally inclined side segments interconnecting the upper and lower segments thereof.

4. A washing and painting apparatus according to claim 3, wherein said first and second generally inclined side segments are generally parallel to one another.

5. A washing and painting apparatus according to claim 3, wherein said washing station is positioned beneath and adjacent to an upstream portion of said lower segment of said conveyor.

6. A washing and painting apparatus according to claim 5, wherein said washing station is connected to said frame structure for movement between the raised and lowered positions thereof.

7. A washing and painting apparatus according to claim 1, wherein said washing station is operable to wash and dry each object.

8. A washing and painting apparatus according to claim 7, said washing receptacle structure comprising a washing chamber and a first drying chamber downstream of said washing chamber.

9. A washing and painting apparatus according to claim 8, further comprising a drying structure disposed within said first drying chamber operable to dry the object or objects disposed within the drying chamber.

10. A washing and painting apparatus according to claim 9, wherein said drying structure is operable to apply streams of air to objects disposed within said first drying chamber.

11. A washing and painting apparatus according to claim 8, said washing receptacle structure further comprising a rinsing chamber downstream of said first drying chamber and having a rinsing structure disposed therein operable to apply a rinsing solution to the surfaces of each object disposed therein.

12. A washing and painting apparatus according to claim 11, said washing receptacle structure further comprising a second drying chamber downstream of said rinsing chamber and having drying structure mounted therein operable to dry objects disposed in said second drying chamber.

13. A washing and painting apparatus according to claim 1, said washing receptacle structure further comprising a lid member operable to seal said washing receptacle structure when said washing receptacle structure is in its raised position so that the objects are sealed within said washing receptacle structure when the washing receptacle structure is in its raised position.

14. A washing and painting apparatus according to claim 1, further comprising a washing solution processing assembly operable to supply and to re-circulate fluids through said washing station.

15. A washing and painting apparatus according to claim 3, wherein said painting station is positioned beneath and adjacent a downstream portion of said lower segment of said looped conveyor.

16. A washing and painting apparatus according to claim 15, wherein said painting station is connected to the apparatus frame structure.

17. A washing and painting apparatus according to claim 15, said painting station further comprising a paint recollection receptacle in fluid communication with said paint reservoir and a paint circulation pump assembly operable to produce a continuous flow of paint between said paint reservoir and said paint recollection receptacle to prevent stagnation of paint within said paint reservoir and to maintain a constant volume of paint in said reservoir.

18. A washing and painting apparatus according to claim 17, wherein said paint recollection receptacle extends in the conveying direction a distance at least equivalent to a horizontal extent of said second side segment of said conveyor so that excess paint which drips from objects positioned along said side segment is captured within said paint recollection receptacle.

19. A washing and painting apparatus according to claim 1, wherein said washing station lift mechanism and said painting station lift mechanism are moved between their raised and lowered positions by respective pluralities of lift cylinders.

20. A washing and painting apparatus according to claim 19, wherein said lift cylinder of each plurality thereof is of a pneumatic type.

21. A washing and painting apparatus according to claim 19, wherein said lift cylinder of each plurality thereof is of a hydraulic type.

22. A washing and painting apparatus according to claim 3, wherein said heating station is disposed along an upstream portion of the upper segment % of the conveyor.

23. A washing and painting apparatus according to claim 22, wherein said heating station includes a pair of laterally spaced confronting heating structures arranged relative to the conveyor such that objects are conveyed between and past said heating structures to effect drying of the obj ects.

24. A washing and painting apparatus according to claim 23, wherein said heating structures include a series of infrared heaters operable to emit both heat and infrared radiation to facilitate drying of the paint on each object.

25. A washing and painting apparatus according to claim 1, wherein each attachment structure includes an attachment bar extending laterally outwardly from said conveyor such that ends thereof are disposed laterally outwardly of the conveyor, each attachment bar being configured to support a plurality of objects.

26. A washing and painting apparatus according to claim 1, wherein said apparatus frame structure is rollingly supported to enable said washing and painting apparatus to be moved along a support surface.

27. A washing and painting apparatus according to claim 1, wherein said conveyor includes a track structure having a generally C-shaped cross-section having a slot formed therein facing generally radially outwardly and having a plurality of roller structures disposed within the interior of said track structure and interlinked to one another.

28. A painting apparatus for painting objects, comprising:

an apparatus frame structure;

an endless conveyor assembly mounted to said frame structure and including a conveyor, said conveyor having a series of incrementally spaced attachment structures thereon configured to secure the objects thereon for painting, said conveyor being movable for moving said attachment structures between consecutive incremental positions along said frame structure in a downstream conveying direction, the distance between consecutive incremental positions being generally equal to an incremental spacing between consecutive attachment structures;

a painting station including an upwardly open paint reservoir disposed beneath said conveyor and configured to contain a volume of paint therein, and a painting station lift mechanism constructed to move said paint reservoir between (a) a raised position wherein said paint reservoir is raised upwardly to receive therein one of the obj ects which is in a painting incremental position so as to dispose the object within the volume of paint and (b) a lowered position wherein said paint reservoir is disposed below the vertical extent of the object to thereby allow the object to be conveyed downstream from the painting incremental position; and a heating station including one or more heaters disposed along said conveyor downstream of said paint reservoir and being constructed to apply heat to one of the objects which is in a heating incremental position.

29. A painting apparatus according to claim 28, wherein said conveyor is an upright closed loop conveyor.

30. A painting apparatus according to claim 29, wherein said upright looped conveyor includes substantially horizontal upper and lower segments which are generally parallel to one another and first and second generally inclined side segments interconnecting the upper and lower segments thereof.

31. A painting apparatus according to claim 30, wherein said first and second generally inclined side segments are generally parallel to one another.

32. A painting apparatus according to claim 31, wherein said painting station is positioned beneath and adjacent a downstream portion of said lower segment of said looped conveyor.

33. A painting apparatus according to claim 28, wherein said painting station is connected to said apparatus frame structure.

34. A painting apparatus according to claim 28, said painting station further comprising a paint recollection receptacle in fluid communication with said paint reservoir and a paint circulation pump assembly operable to produce a continuous flow of paint between said paint reservoir and said paint recollection receptacle to prevent stagnation of paint within said paint reservoir and to maintain a constant volume of paint in said paint reservoir.

35. A painting apparatus according to claim 34, wherein said paint recollection receptacle and said conveyor areconstructed and arranged so that excess paint from objects downstream of said painting station drips into said paint recollection receptacle.

36. A painting apparatus according to claim 28, wherein said painting station lift mechanism is moved between its raised and lowered positions by a plurality of lift cylinders.

37. A painting apparatus according to claim 36, wherein each said lift cylinder of said plurality thereof is of a pneumatic type.

38. A painting apparatus according to claim 36, wherein each said lift cylinder of said plurality thereof is of a hydraulic type.

39. A painting apparatus according to claim 28, wherein said heating station includes a pair of laterally spaced confronting heating structures arranged relative to said conveyor such that objects are conveyed between and past said heating structures to effect drying of the objects.

40. A painting apparatus according to claim 39, wherein said heating structures include a series of infrared heaters operable to emit both heat and infrared radiation to facilitate drying of the paint on each object.

41. A painting apparatus according to claim 28, each attachment structure comprising an attachment bar extending laterally outwardly from said conveyor such that ends thereof are disposed laterally outwardly of said conveyor, each said attachment bar being configured to support a plurality of objects.

42. A painting apparatus according to claim 28, wherein said apparatus frame structure is rollingly supported to enable said painting apparatus to be moved along a support surface.

43. A painting apparatus according to claim 28, wherein said conveyor includes a track structure having a generally C-shaped cross-section having a slot formed therein facing generally radially outwardly and having a plurality of roller structures disposed within the interior of said track structure and interlinked to one another.

44. A washing and painting apparatus for washing and painting objects, comprising:

an apparatus frame structure;

an endless conveyor assembly mounted to the frame structure and including a conveyor, the conveyor having a series of incrementally spaced attachment structures thereon configured to secure the objects thereon for washing and painting, the conveyor being movable for moving the attachment structures between consecutive incremental positions along the frame structure in a downstream conveying direction, the distance between consecutive incremental positions being generally equal to an incremental spacing between consecutive attachment structures;

a washing station including a washing receptacle structure disposed beneath said conveyor and configured to apply a cleaning solution to objects disposed therein, and a washing station lift mechanism constructed to move the washing receptacle structure between (a) a raised position wherein the washing receptacle structure is raised upwardly to receive therein one of the objects which is in a washing incremental position so as to apply the cleaning solution to surfaces of the object and (b) a lowered position wherein the washing receptacle structure is disposed below a vertical extent of the object to thereby allow the object to be conveyed downstream from the washing incremental position;

a painting station disposed beneath said conveyor downstream of said washing receptacle structure, said paint station being configured to apply paint to one of the objects which is in a painting incremental position; and a heating station including one or more heaters disposed along said conveyor downstream of said paint reservoir and being constructed to apply heat to one of the objects which is in a heating incremental position.

45. A washing and painting apparatus according to claim 44, wherein said painting station is constructed to apply paint to each object by a powder coating operation.

46. A washing and painting apparatus according to claim 44, wherein said painting station is constructed to apply paint to each object by a paint spraying operation.

47. A washing and painting apparatus according to claim 46, wherein said painting station is constructed and arranged to spray paint using a conventional paint spraying operation.

48. A washing and painting apparatus according to claim 46, wherein said painting station is constructed and arranged to spray paint using an electrostatic spraying operation.

49. A washing and painting apparatus according to claim 44, wherein said conveyor is an upright closed loop conveyor.

50. A washing and painting apparatus according to claim 49, wherein said upright looped conveyor includes substantially horizontal upper and lower segments which are generally parallel to one another and first and second generally inclined side segments interconnecting the upper and lower segments thereof.

51. A washing and painting apparatus according to claim 50, wherein said first and second generally inclined side segments are generally parallel to one another.

52. A washing and painting apparatus according to claim 51, wherein said washing station is positioned beneath and adjacent to an upstream portion of said lower segment of said conveyor.

53. A washing and painting apparatus according to claim 52, wherein said painting station is positioned beneath and adjacent a downstream portion of said lower segment of said looped conveyor.

54. A washing and painting apparatus according to claim 53, wherein said painting station is connected to said apparatus frame structure.

55. A washing and painting apparatus according to claim 54, wherein said washing station is connected to said frame structure for movement between the raised and lowered positions thereof.

56. A washing and painting apparatus according to claim 55, wherein said washing station is operable to wash and dry each object.

57. A washing and painting apparatus according to claim 56, said washing receptacle structure comprising a washing chamber and a first drying chamber downstream of said washing chamber.

58. A washing and painting apparatus according to claim 57, said washing receptacle structure further comprising a drying structure mounted in said first drying chamber operable to apply streams of air to objects disposed within said first drying chamber.

59. A washing and painting apparatus according to claim 58, said washing receptacle structure further comprising a rinsing chamber downstream of said first drying chamber and having a rinsing structure disposed therein operable to apply a rinsing solution to the surfaces of each object disposed therein.

60. A washing and painting apparatus according to claim 59, said washing receptacle structure further comprising a second drying chamber downstream of said rinsing chamber and having drying structure mounted therein operable to dry obj ects disposed in said second drying chamber.

61. A washing and painting apparatus according to claim 44, said washing station further comprising a lid member operable to seal said washing receptacle structure when said washing receptacle structure is in its raised position so that the objects are sealed within said washing receptacle structure when said washing receptacle structure is in its raised position.

62. A washing and painting apparatus according to claim 44, further comprising a washing solution processing assembly operable to supply and to re-circulate fluids through said washing station.

63. A washing and painting apparatus according to claim 44, said painting station comprising an upwardly open paint reservoir configured to contain a volume of paint therein, and a painting station lift mechanism constructed to move said paint reservoir between (a) a raised position wherein said paint reservoir is raised upwardly to receive therein one of the objects which is in a painting incremental position so as to dispose the object within the volume of paint and (b) a lowered position wherein said paint reservoir is disposed below the vertical extent of the object to thereby allow the object to be conveyed downstream from the painting incremental position.

64. A washing and painting apparatus according to claim 63, further comprising a paint recollection receptacle in fluid communication with said paint reservoir and a paint circulation pump assembly operable to produce a continuous flow of paint between said paint reservoir and said paint recollection receptacle to prevent stagnation of paint within said paint reservoir and to maintain a constant volume of paint within said paint reservoir.

65. A washing and painting apparatus according to claim 64, wherein said paint recollection receptacle extends in the conveying direction and is constructed and arranged such that excess paint which drips from objects positioned downstream of said painting station is captured within said paint recollection receptacle.

66. A washing and painting apparatus according to claim 65, wherein said washing station lift mechanism and said painting station lift mechanism are moved between their raised and lowered positions by respective pluralities of lift cylinders.

67. A washing and painting apparatus according to claim 66, wherein each said lift cylinder of each said plurality thereof is of a pneumatic type.

68. A washing and painting apparatus according to claim 67, wherein each said lifi cylinder of each said plurality thereof is of a hydraulic type.

69. A washing and painting apparatus according to claim 44, wherein said heating station includes a pair of laterally spaced confronting heating structures arranged relative to the conveyor such that objects are conveyed between and past said heating structures to effect drying of the objects.

70. A washing and painting apparatus according to claim 69, wherein said heating structures include a series of infrared heaters operable to emit both heat and infrared radiation to facilitate drying of the paint on each object.

71. A washing and painting apparatus according to claim 44, wherein each attachment structure includes an attachment bar extending laterally outwardly from said conveyor such that ends thereof are disposed laterally outwardly of said conveyor, each said attachment bar being configured to support a plurality of objects.

72. A washing and painting apparatus according to claim 44, wherein said apparatus frame structure is rollingly supported to enable said washing and painting apparatus to be moved along a support surface.

73. A washing and painting apparatus according to claim 44, wherein said conveyor includes a track structure having a generally C-shaped cross-section having a slot formed therein facing generally radially outwardly and having a plurality of roller structures disposed within the interior of said track structure and interlinked to one another.

74. A painting apparatus for painting objects, comprising:

an apparatus frame structure;

an endless conveyor assembly mounted to said frame structure and including a conveyor, said conveyor having a series of incrementally spaced attachment structures thereon configured to secure the objects thereon for washing and painting, said conveyor being movable for moving said attachment structures between consecutive incremental positions along said frame structure in a downstream conveying direction, the distance between consecutive incremental positions being generally equal to an incremental spacing between consecutive attachment structures;

a painting station including an upwardly open paint reservoir disposed beneath said conveyor and being configured to contain a volume of paint therein, and a mechanism constructed to effect relative vertical movement between one of the objects which is in a painting incremental position and said paint reservoir structure so as to dispose the object within the volume of paint, said painting station including a paint recollection receptacle disposed adjacent said paint reservoir and extending downstream therefrom to a subsequent incremental position and being configured to catch excess paint which drips from objects in the subsequent incremental position, wherein interiors of said paint reservoir and said paint recollection receptacle are separated from one another via at least a wall member, said painting station including a pump mechanism communicated with said interiors of said paint reservoir and said paint recollection receptacle and being constructed to transport the excess paint caught by said recollection receptacle into said paint reservoir.

75. A painting apparatus according to claim 74, wherein said conveyor is an upright closed loop conveyor.

76. A painting apparatus according to claim 75, wherein said upright looped conveyor includes substantially horizontal upper and lower segments which are generally paralell to one another and first and second generally inclined side segments interconnecting the upper and lower segments thereof.

77. A painting apparatus according to claim 76, wherein said first and second generally inclined side segments are generally parallel to one another.

78. A painting apparatus according to claim 77, wherein said painting station is positioned beneath and adjacent a downstream portion of said lower segment of said looped conveyor.

79. A painting apparatus according to claim 78, wherein said painting station is connected to the apparatus frame structure.

80. A painting apparatus according to claim 79, wherein said paint recollection receptacle extends in the conveying direction a distance at least equivalent to a horizontal extent of said second side segment of said conveyor so that excess paint which drips from objects positioned along said side segment is captured within said paint recollection receptacle.

81. A painting apparatus according to claim 74, said mechanism constructed to effect relative vertical movement comprising a painting station lift mechanism that includes one or more lift cylinders operable to move said paint reservoir between (a) a raised position wherein said paint reservoir is raised upwardly to receive therein one of the objects which is in a painting incremental position so as to dispose the object within the volume of paint and (b) a lowered position wherein said paint reservoir is disposed below the vertical extent of the object to thereby allow the object to be conveyed downstream from the painting incremental position.

82. A painting apparatus according to claim 81, wherein said lift cylinder of each plurality thereof are of a pneumatic type.

83. A painting apparatus according to claim 81, wherein said lift cylinder of each plurality thereof are of a hydraulic type.

84. A painting apparatus according to claim 74, wherein each attachment structure includes an attachment bar extending laterally outwardly from said conveyor such that ends thereof are disposed laterally outwardly of the conveyor, each attachment bar being configured to support a plurality of objects.

85. A washing and painting apparatus according to claim 74, wherein said apparatus frame structure is rollingly supported to enable said washing and painting apparatus to be moved along a support surface.

86. A washing and painting apparatus according to claim 74, wherein said conveyor includes a track structure having a generally C-shaped cross-section having a slot formed therein facing generally radially outwardly and having a plurality of roller structures disposed within the interior of said track structure and interlinked to one another.

* * * * *

UNITED STATES PATENT AND TRADEMARK OFFICE

CERTIFICATE OF CORRECTION

PATENT NO. : 6,767,406 B2
DATED : July 27, 2004
INVENTOR(S) : Donald Vitale

It is certified that error appears in the above-identified patent and that said Letters Patent is hereby corrected as shown below:

Column 3,
Line 7, "is'" should read -- is --.

Column 18,
Line 48, remove "%" after "segment".
Line 53, "obj ects" should read -- objects --.

Column 19,
Line 25, "obj ects" should read -- objects --.
Line 64, "arecon-" should read -- are con- --.

Column 21,
Line 64, "obj ects" should read -- objects --.

Column 22,
Line 44, "lifi" should read -- lift --.

Signed and Sealed this

Twenty-second Day of February, 2005

JON W. DUDAS
*Director of the United States Patent and Trademark Office*